US009174707B2

(12) United States Patent
Jang et al.

(10) Patent No.: US 9,174,707 B2
(45) Date of Patent: Nov. 3, 2015

(54) SHIP FOR TRANSPORTING A LIQUEFIED NATURAL GAS STORAGE CONTAINER

(75) Inventors: In Ho Jang, Seoul (KR); Sung Gun Park, Geoje-si (KR); Joong Kyoo Kang, Seoul (KR); Jung Han Lee, Geoje-si (KR)

(73) Assignee: DAEWOO SHIPBUILDING & MARINE ENGINEERING CO., LTD., Seoul (KR)

( * ) Notice: Subject to any disclaimer, the term of this patent is extended or adjusted under 35 U.S.C. 154(b) by 182 days.

(21) Appl. No.: 13/640,477

(22) PCT Filed: Mar. 16, 2011

(86) PCT No.: PCT/KR2011/001832

§ 371 (c)(1),
(2), (4) Date: Dec. 6, 2012

(87) PCT Pub. No.: WO2012/053705

PCT Pub. Date: Apr. 26, 2012

(65) Prior Publication Data

US 2013/0192510 A1 Aug. 1, 2013

(30) Foreign Application Priority Data

Oct. 18, 2010 (KR) ..... 10-2010-0101569

(51) Int. Cl.
*B63B 11/02* (2006.01)
*B63B 25/08* (2006.01)
(Continued)

(52) U.S. Cl.
CPC ..... *B63B 25/14* (2013.01); *B63B 11/02* (2013.01); *B63B 25/08* (2013.01); *B63B 25/12* (2013.01);
(Continued)

(58) Field of Classification Search
CPC ..... B63B 25/08; B63B 25/12–25/16; B63B 2025/085; B63B 2025/087; B63B 2701/12; B63B 2701/18; B63B 2701/22; F17C 13/08; F17C 2270/0105; F17C 2270/0107; F17C 1/002; F17C 13/082
USPC ..... 114/74 R, 74 T, 74 A; 220/560, 560.07, 220/560.11, 901
See application file for complete search history.

(56) References Cited

U.S. PATENT DOCUMENTS

| | | | | |
|---|---|---|---|---|
| 1,699,649 A * | 1/1929 | Willoughby | ..... | 105/360 |
| 2,537,085 A * | 1/1951 | Phelps | ..... | 114/74 A |
| 2,600,015 A * | 6/1952 | McLaughlin | ..... | 220/88.1 |

(Continued)

FOREIGN PATENT DOCUMENTS

| | | | |
|---|---|---|---|
| EP | 0619222 | A2 | 10/1994 |
| JP | 58-174799 | A | 10/1983 |
| JP | 63-107295 | U | 7/1988 |
| JP | 2003-118683 | A | 4/2003 |

OTHER PUBLICATIONS

International Search Report for PCT/KR2011/001832 filed on Mar. 16, 2011.

*Primary Examiner* — Ajay Vasudeva

(57) ABSTRACT

An LNG storage container carrier includes: one or more cargo holds provided on a hull such that upper portions thereof are opened; a plurality of first and second upper supports installed on the cargo holds in a width direction and a length direction to partition the upper portions of the cargo holds into a plurality of openings, wherein storage containers are vertically inserted into the openings and supported; and a lower support installed under the cargo holds and supporting the bottoms of the storage containers inserted into the openings. Accordingly, it is possible to efficiently and stably transport the storage containers storing LNG or PLNG pressurized at a predetermined pressure. Such storage containers may be transported through simple modification of the existing container carrier.

14 Claims, 32 Drawing Sheets

(51) Int. Cl.

| | |
|---|---|
| ***B63B 25/12*** | (2006.01) |
| ***B63B 25/14*** | (2006.01) |
| ***B63B 25/16*** | (2006.01) |
| ***F17C 13/08*** | (2006.01) |
| ***F17C 1/00*** | (2006.01) |

(52) U.S. Cl.
CPC ..... *B63B 25/16* (2013.01); *F17C 1/002* (2013.01); *F17C 13/082* (2013.01); *B63B 2025/087* (2013.01)

(56) References Cited

U.S. PATENT DOCUMENTS

| | | | | |
|---|---|---|---|---|
| 3,270,700 | A * | 9/1966 | Kohn et al. | 114/74 A |
| 3,935,957 | A * | 2/1976 | Hasegawa | 220/560.1 |
| 3,937,353 | A * | 2/1976 | Becker et al. | 220/560.12 |
| 4,083,318 | A * | 4/1978 | Verolme | 114/74 A |
| 5,375,547 | A | 12/1994 | Abe et al. | |
| 5,618,148 | A * | 4/1997 | Iversen et al. | 414/139.9 |
| 7,128,008 | B2 * | 10/2006 | Lothe | 114/74 A |

* cited by examiner (a)

(b)

(c)

(a)

(b)

SHIP FOR TRANSPORTING A LIQUEFIED NATURAL GAS STORAGE CONTAINER

BACKGROUND OF THE INVENTION

1. Field of the Invention

The present invention relates to a liquefied natural gas (LNG) storage container carrier, and more particularly, to an LNG storage container carrier, which is capable of efficiently and stably transporting LNG storage containers and capable of reducing manufacturing costs and time.

2. Description of the Related Art

In general, liquefied natural gas (LNG) is a cryogenic liquid produced by cooling natural gas (predominantly methane) to a cryogenic state of −162° C. at atmospheric pressure. The LNG takes up about 1/600th the volume of natural gas. The LNG is colorless and transparent. It has been known that the LNG is cost-efficient in terms of a long-distance transportation because of high transportation efficiency as compared to a gaseous state.

Since a large amount of cost is spent in the construction of production plants and the building of carriers, the LNG has been applied to a large-scale long-distance transportation in order for cost reduction. On the other hand, it has been known that a pipeline or compressed natural gas (CNG) is cost-efficient in terms of small-scale short-distance transportation. However, the transportation using the pipeline may have geographical restrictions and cause environmental pollution, and the CNG has low transportation efficiency.

A conventional method for distributing LNG to consumption places requires high costs and has difficulty in flexibly responding to various demands of consumption places. Also, since it is necessary to provide separate storage tanks at the consumption places, high infrastructure costs are needed and a lot of time and effort to unload LNG are needed.

In addition, natural gas has a liquefaction point of −163° C. at atmospheric pressure. If a predetermined pressure is applied, the liquefaction point of the natural gas further increases than at the atmospheric pressure. This characteristic may reduce processing steps in a liquefaction process, such as acid gas removal and natural gas liquid (NGL) fractionation. This leads to a reduction in facilities and facility capacity. Therefore, the LNG production costs may be reduced.

However, a conventional LNG storage tank installed in a vessel having a gasification facility or an LNG terminal has a limitation in size. In addition, it is unsuitable for cost-efficient storage of LNG while reflecting the above-described LNG characteristic. It is difficult to easily transport LNG to consumption places according to consumer's various demands.

To solve the above problems, a storage container for storing and carrying general LNG or PLNG pressurized at a predetermined pressure has been developed.

Such LNG storage containers are difficult to transport by a conventional LNG carrier or cargo ship. Therefore, there is a need for developing a carrier that can efficiently and stably transport an LNG storage container and can reduce manufacturing costs and time.

SUMMARY OF THE INVENTION

An aspect of the present invention is directed to an LNG storage container carrier, which is capable of efficiently and stably transporting a storage container for storing general LNG or PLNG pressurized at a predetermined pressure.

Another aspect of the present invention is directed to reduce time and cost for manufacturing an LNG storage container carrier, improving economic feasibility.

According to an embodiment of the present invention, an LNG storage container carrier includes: one or more cargo holds provided on a hull such that upper portions thereof are opened; a plurality of first and second upper supports installed on the cargo holds in a width direction and a length direction to partition the upper portions of the cargo holds into a plurality of openings, wherein storage containers are vertically inserted into the openings and supported; and a lower support installed under the cargo holds and supporting the bottoms of the storage containers inserted into the openings.

The LNG storage container carrier may further include a plurality of support blocks installed to support sides of the storage containers in some or entire portions of the inner surfaces of the cargo holds and the first and second upper supports.

The support blocks may be provided to support the front and rear and the left and right of the storage containers, and the support blocks may have support planes with a curvature corresponding to a curvature of the outer surfaces of the storage containers.

The lower support may be provide in plurality, the plurality of lower supports may be vertically installed upwardly on the bottom of the cargo holds, and reinforcement members may be installed to maintain the gaps between the lower supports.

A container loading table may be provided to carry container boxes together with the storage containers.

The LNG may be a pressurized LNG liquefied at a pressure of 13 to 25 bar and a temperature of −120 to −95° C., and the storage container may have a dual structure. A connection passage may be provided between the dual structure of the storage container and the inside of the storage container in order for pressure balance between an internal pressure of the dual structure of the storage container and an internal pressure of the storage container.

According to another embodiment of the present invention, an LNG storage container carrier includes: a plurality of first and second upper supports installed on cargo holds provided on a hull such that upper portions of the cargo holds are partitioned into a plurality of openings, wherein storage containers inserted into the openings are supported by the first and second upper supports.

The LNG may be a pressurized LNG liquefied at a pressure of 13 to 25 bar and a temperature of −120 to −95° C., and the storage container may have a dual structure. A connection passage may be provided between the dual structure of the storage container and the inside of the storage container in order for pressure balance between an internal pressure of the dual structure of the storage container and an internal pressure of the storage container.

<Description of Reference Numerals>

Figure 1:
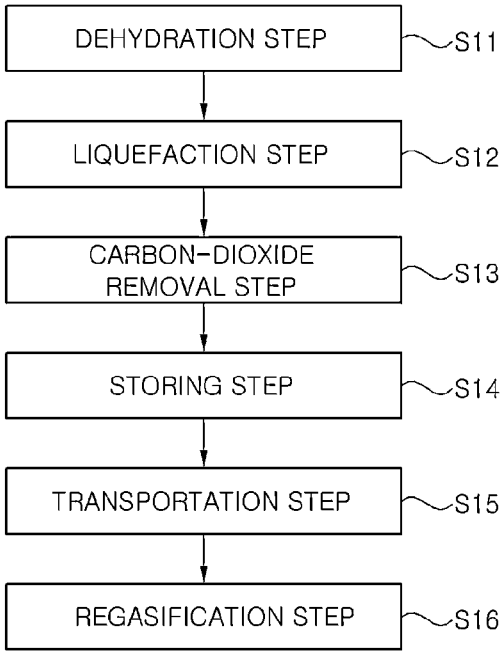
FIG. 1 is a flow diagram showing a PLNG producing method according to the present invention.

| | |
|---|---|
| 1: natural gas field | 2: vessel |
| 3: place of consumption | 3a: consumer |
| 4: valve | 5: quay |
| 6: storage tank | 7: loading line |
| 7a: valve | 8: unloading line |
| 8a: valve | 9a: external injection part |
| 10: PLNG production system | 11: dehydration facility |
| 12: liquefaction facility | 13: carbon-dioxide removal facility |
| 14: storage facility | 21: storage container |
| 21a: nozzle | 22: container assembly |
| 22a: integral nozzle | 23: regasification system |
| 30: LNG storage tank | 31: main body |
| 31a: spacer | 31b: support |
| 32: storage container | 33: loading/unloading line |
| 33a, 33b: loading/unloading valve | 34: BOG line |
| 34a, 34b: BOG valves | 35: pressure sensing unit |
| 36: controlling unit | 36a: manipulating unit |
| 37: displaying unit | 38: heating unit |
| 38a: heat exchanger | 38b: electric heater |
| 39: heating value adjusting unit | 41: bypass line |
| 41a: bypass valve | 42: temperature sensing unit |
| 50: storage container | 51: inner shell |

-continued

<Description of Reference Numerals>

51a: inlet/outlet port
52: outer shell
53: heat insulation layer part
54: connection passage
55: connecting part
56: external heat insulation layer
57: heating member
60, 70: storage container
61: inner shell
62: outer shell
63: support
63a: first flange
63b: second flange
63c: first web
64: heat insulation layer part
65: heat insulation member
66: lower support
80, 90: storage container
81: inner shell
82: outer shell
83: metal core
83a: support point
84: heat insulation layer part
86: lower support
100: storage container
95: inner shell
120: outer shell
130: heat insulation layer part
140, 150, 160, 170: connecting part
141, 151, 161,: injection part
142, 152, 162, 172: first flange
143: extension part
144, 174: second flange
163: coupling member
163a: coupling part
181, 183: bolt
182: nut
200: PLNG production apparatus
210: coolant supply unit
211: coolant line
220: supply line
221: first branch line
230: heat exchanger
240: recycling unit
241: recycled liquid supply part
242: recycled liquid line
243: first valve
244: second valve
250: sensing unit
260: controlling unit
270: third valve
300: floating structure having storage tank carrying apparatus
310: storage tank carrying apparatus
311: elevating unit
311a: loading table
311b: movable foothold
311c: hinge coupling part
311d: auxiliary rail
312: rail
313: cart
313a: wheel
313b: tank protection pad
320: floating structure
330: storage tank
400: system for maintaining high pressure of PLNG storage container
410: unloading line
411: storage container
420: pressure compensation line
430: evaporator
440: BOG line
450: compressor
510: storage container
511: inner shell
512: outer shell
513: heat insulation layer part
514: equalizing line
514a: on/off valve
514b: second exhaust valve
514c: second exhaust valve
515: first exhaust valve
515a: first exhaust valve
516a: first connecting part
516b: second connecting part
517: support
518: lower support
520: storage container
521: inner shell
521a: injection port
522: outer shell
522a: extension part
523: heat insulation layer part
524: connecting part
525, 526, 527: buffer part
525a, 526a, 527a: loop
525b: joint part
610, 640: natural gas liquefaction apparatus having separable heat exchanger
620, 650: liquefaction heat exchanger
621: first passage
622: second passage
623: liquefaction line
624: on/off valve
630, 660: coolant cooling part
631, 632, 661: coolant heat exchanger
631a, 632a, 661a: first passage
631b, 632b, 661b: second passage
631c: third passage
633, 663: compressor
634, 664: after-cooler
635: separator
636a: first J-T valve
636b: second J-T valve
636c: third J-T valve
637: coolant supply line
638: coolant circulation line
638a: gaseous line
638b: liquid line
638c: connecting line
665: expander
666: flow distribution valve
700: LNG storage container carrier
710: hull
711: deck
720: cargo hold
721: opening
730: first upper support
740: second upper support
750: lower support
751: reinforcement member
760: support block
761: support plane
770: container loading part
791: storage container
792: container box
810: solidified carbon-dioxide removal system -continued <Description of Reference Numerals>

811: supply line
812: expansion valve
813: solidified carbon-dioxide filter
814: first on/off valve
815: second on/off valve
816: heating unit
816a: heat medium line
816b: regenerative heat exchanger
816c: fourth on/off valve
816d: fifth on/off valve
817: third on/off valve
817a: exhaust line
820: connection structure of LNG storage tank
821: sliding connecting part
822: connecting part
823: connecting part
824: extension part
830: LNG storage container
831: inner shell
831a: injection port
832: outer shell
833: heat insulation layer part
840: external injection part

DETAILED DESCRIPTION OF EXEMPLARY EMBODIMENTS

Exemplary embodiments of the present invention will be described below in detail with reference to the accompanying drawings. Throughout the disclosure, like reference numerals refer to like parts throughout the drawings and embodiments of the present invention.

FIG. 1 is a flow diagram showing a PLNG producing method according to the present invention.

As shown in FIG. 1, the PLNG producing method according to the present invention produces PLNG by removing water from natural gas, without a process of removing acid gas from natural gas supplied from a natural gas field 1, and liquefying the natural gas by pressurization and cooling, without a process of fractionating the natural gas into natural gas liquid (NGL). To this end, the PLNG producing method may include a dehydration step S11 and a liquefaction step S12.

In the dehydration step S11, water such as water vapor is removed from natural gas by a dehydration process, without a process of removing acid gas from natural gas supplied from a natural gas field 1. That is, the dehydration process is performed on the natural gas, without undergoing the acid gas removal process. The skip of the acid gas removal process may simplify the producing process and reduce investment costs and maintenance expenses. In addition, since water is sufficiently removed from the natural gas in the dehydration step S11, it is possible to prevent the water freezing of the natural gas at the operating temperature and pressure of the production system.

In the liquefaction step S12, PLNG is produced by liquefying the dehydrated natural gas at a pressure of 13 to 25 bar and a temperature of −120 to −95° C., without an NGL fractionation process. For example, the PLNG having a pressure of 17 bar and a temperature of −115° C. may be produced. Since the process of fractionating the NGL, i.e., liquid hydrocarbon, from the natural gas is skipped, the LNG producing process may be simplified and the power consumption for cooling and liquefying the natural gas to a cryogenic temperature. Therefore, investment costs and maintenance expenses are reduced, lowering the production costs of LNG.

In the PLNG producing method according to the present invention, the condition of the natural gas field 1 may be that the produced natural gas has carbon dioxide ($CO_2$) of 10% or less. In addition, when an amount of carbon dioxide existing in the natural gas after the dehydration step S11 is 10% or less, a carbon dioxide removal step S13 of freezing and removing carbon dioxide may be further included in the liquefaction step S12.

The carbon dioxide removal step S13 may be performed when an amount of carbon dioxide existing in the natural gas after the dehydration step S11 is larger than 2% or equal to or smaller than 10%. When an amount of carbon dioxide is 2% or less, the natural gas exists in a liquid state under PLNG temperature and pressure conditions which will be described below. Therefore, even though the carbon dioxide removal step S13 is not performed, the production and transportation of PLNG are not affected. When an amount of carbon dioxide is larger than 2% and equal to or smaller than 10%, the natural gas is frozen as a solid state. Therefore, the carbon dioxide removal step S13 is carried out in order for liquefaction.

After the liquefaction step S12, a storing step S14 may be performed to store the PLNG, which is produced in the liquefaction step S12, in a storage container having a dual structure. Hence, the PLNG is transported to a desired position. To this end, a transportation step S15 may be performed to transport the PLNG through an individual or packaged storage container by a vessel. Also, the PLNG may be transported by a vessel through an individual or packaged storage container having a reinforced tank strength.

The storage container used in the transportation step S15 may be constructed and made of a material such that it can withstand a pressure of 13 to 25 bar and a temperature of −120 to −95° C. In addition, the vessel for transporting the storage container may be an existing barge or container ship, instead of a separate vessel such as an LNG carrier. Therefore, expenses for transporting the storage container may be reduced.

In this case, the storage container may be loaded into and transported by the barge or container ship that is not modified or minimally modified. The storage container to be transported by the vessel may be delivered on the basis of the individual storage container according to a request of a consumption place.

Meanwhile, the PLNG stored in the storage container delivered to a consumer after the transportation step S15 undergoes a regasification step S16 at a final consumption place and is supplied as a gaseous natural gas. A regasification facility for performing the regasification step S16 may be configured with a high pressure pump and a vaporizer. In the case of an individual consumption place such as a power plant or a factory, a self regasification facility may be installed.

Figure 2:
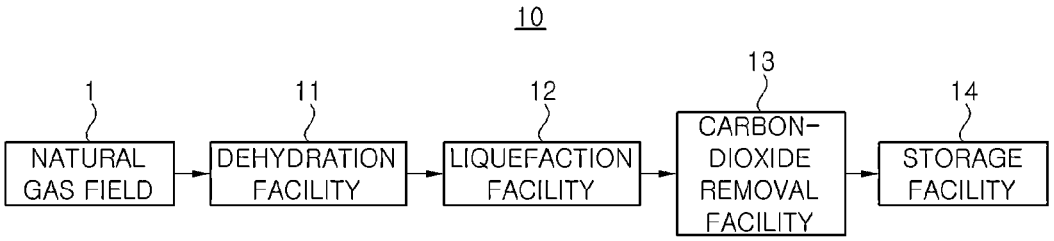
FIG. 2 is a configuration diagram showing a PLNG production system according to the present invention.

FIG. 2 is a configuration diagram showing a PLNG production system according to the present invention.

As shown in FIG. 2, a PLNG production system 10 according to the present invention may include a dehydration facility 11 for dehydrating natural gas supplied from a natural gas field 1, and a liquefaction facility 12 for liquefying the dehydrated natural gas to a pressure of 13 to 25 bar and a temperature of −120 to −95° C. and producing PLNG.

The dehydration facility 11 performs a dehydration process to remove water such as water vapor from the natural gas supplied from the natural gas field 1, thereby preventing the freezing of the natural gas at an operating temperature and pressure of the production system. At this time, the natural gas supplied from the natural gas field 1 to the dehydration facility 11 does not undergo an acid gas removal process. Therefore, the LNG producing process may be simplified and the investment costs and maintenance expenses may be reduced.

The liquefaction facility 12 produces the PLNG by liquefying the dehydrated natural gas at a pressure of 13 to 25 bar and a temperature of −120 to −95° C. For example, the liquefaction facility 12 may produce PLNG having a pressure of 17 bar and a temperature of −115° C. To this end, the liquefaction facility 12 may include a compressor and a cooler for compressing and cooling a low-temperature liquid. The natural gas supplied from the dehydration facility 11 is supplied to the liquefaction facility 12 and undergoes a liquefaction step, without an NGL fractionation process. Due to the skip of the NGL (liquid hydrocarbon) fractionation process, the manufacturing costs and maintenance expenses of the system may be reduced, and thus, the production costs of the LNG may be reduced.

When an amount of carbon dioxide contained in the natural gas supplied from the dehydration facility 11 is 10% or less, the PLNG production system 10 according to the present invention may further include a carbon-dioxide removal facility 13 for freezing the carbon dioxide and removing the carbon dioxide from the natural gas.

The carbon-dioxide removal facility 13 may remove the carbon dioxide from the natural gas only when an amount of the carbon dioxide contained in the natural gas supplied from the dehydration facility 11 is larger than 2% or equal to or smaller than 10%. That is, when an amount of the carbon dioxide contained in the natural gas is 2% or less, the natural gas exists in a liquid state at the temperature and pressure conditions of the PLNG. Thus, it is unnecessary to remove the carbon dioxide. When an amount of the carbon dioxide contained in the natural gas is larger than 2% and equal to or smaller than 10%, the natural gas is frozen as a solid state. Thus, it is necessary to remove the carbon dioxide at the carbon-dioxide removal facility 13.

The PLNG produced from the liquefaction facility 12 is stored in the storage container having a dual structure at a storage facility 14 and is transported to a desired consumption place by a storage container transportation.

Figure 3:
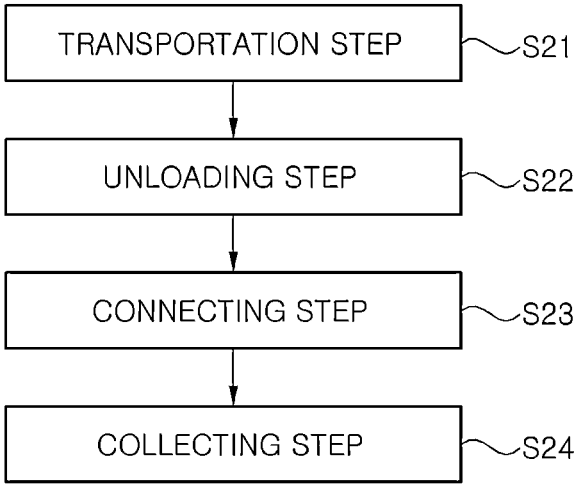
FIG. 3 is a flow diagram showing a PLNG distributing method according to the present invention.

FIG. 3 is a flow diagram showing a PLNG distributing method according to the present invention.

As shown in FIG. 3, the PLNG distributing method according to the present invention pressurizes and cools natural gas to produce PLNG, stores the PLNG in a storage container, loads the storage container, transports the storage container to a consumption place, unloads the storage container at the consumption place, and connects the storage container to a regasification system at the consumption place. To this end, the PLNG distributing method according to the present invention may include a transporting step S21, an unloading step S22, and a connecting step S23.

Figure 4:
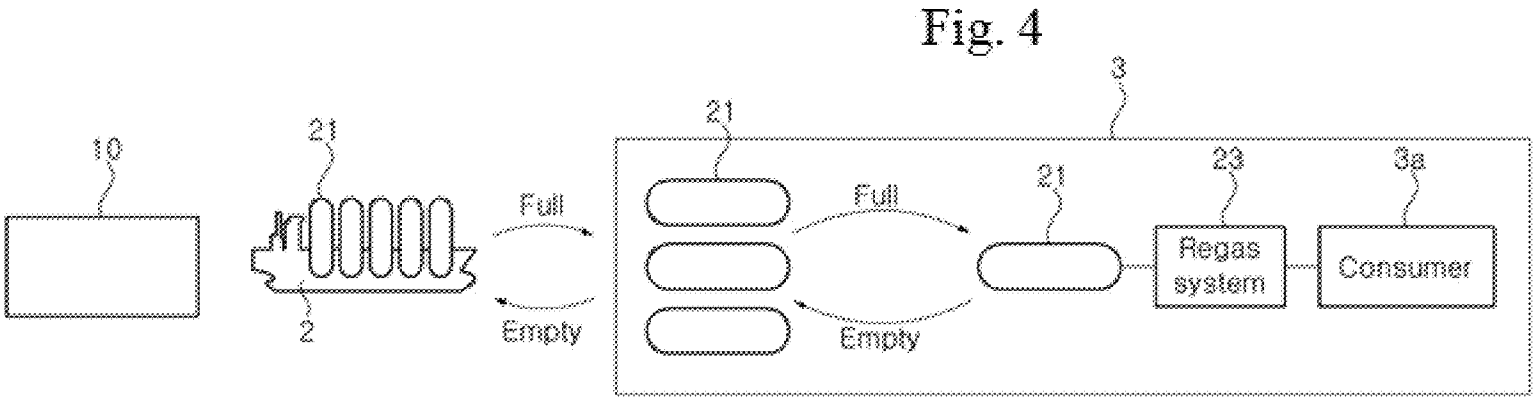
FIG. 4 is a configuration diagram explaining the PLNG distributing method according to the present invention.

As shown in FIG. 4, in the transporting step S21, PLNG produced by liquefying natural gas at a pressure of 13 to 25 bar and a temperature of −120 to −95° C. is stored in a transportable storage container 21, is loaded into a vessel 2, and is transported to a consumption place. The PLNG may be produced by the above-described PLNG producing method. The storage container 21 for storing the produced PLNG may be constructed and made of a material such that it can withstand a pressure of 13 to 25 bar and a temperature of −120 to −95° C. The storage container 21 may have a dual structure. A plurality of storage containers 21 may be loaded into the vessel 2.

In the transporting step S21, the storage container may be transported by a land vehicle, such as a trailer or a train, when the consumption place 3 is located in an inland region.

In the unloading step S22, when the vessel 2 arrives at the consumption place 3, the storage container 21 storing the PLNG is unloaded at the consumption place 3 by an unloading facility. The storage container 21 may be unloaded on the basis of the individual storage container.

Figure 5:
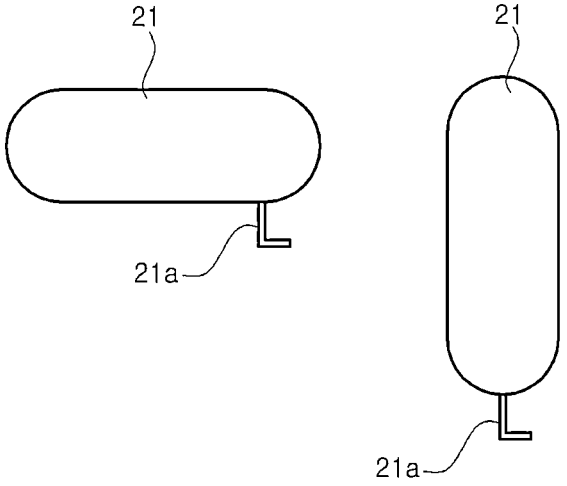
FIG. 5 is a side view showing a pressure container used for the PLNG distributing method according to the present invention.

In the connecting step S23, the storage container 21 is connected to the regasification system 23 at the consumption place 3 so that the PLNG stored in the storage container 21 can be vaporized. The natural gas generated by vaporizing the PLNG stored in the storage container 21 can be supplied to the consumer 3*a*. Meanwhile, as shown in FIG. 5, the storage container 21 is provided with a nozzle 21*a* for inflow and outflow of the PLNG and connection to a vaporization line of the regasification system 23. The nozzle 21*a* may be provided at various positions in various structures, depending on a posture in which the storage container 21 is loaded into the vessel 2 and a posture in which the nozzle 21*a* is connected to the regasification system 23. The nozzle 21*a* may have a connector for connection to a connector of a PLNG storage facility and a connector of the regasification system 23.

The PLNG distributing method according to the present invention may further include a collecting step S24 of collecting the empty storage container 21 from the consumption place 3.

In the collecting step S24, the empty storage container 21 is collected to the place where the PLNG production system 10 is located, by using the land vehicle or a vessel 2. This may contribute to reduction in the distribution costs and the natural gas supply costs.

Figure 6:
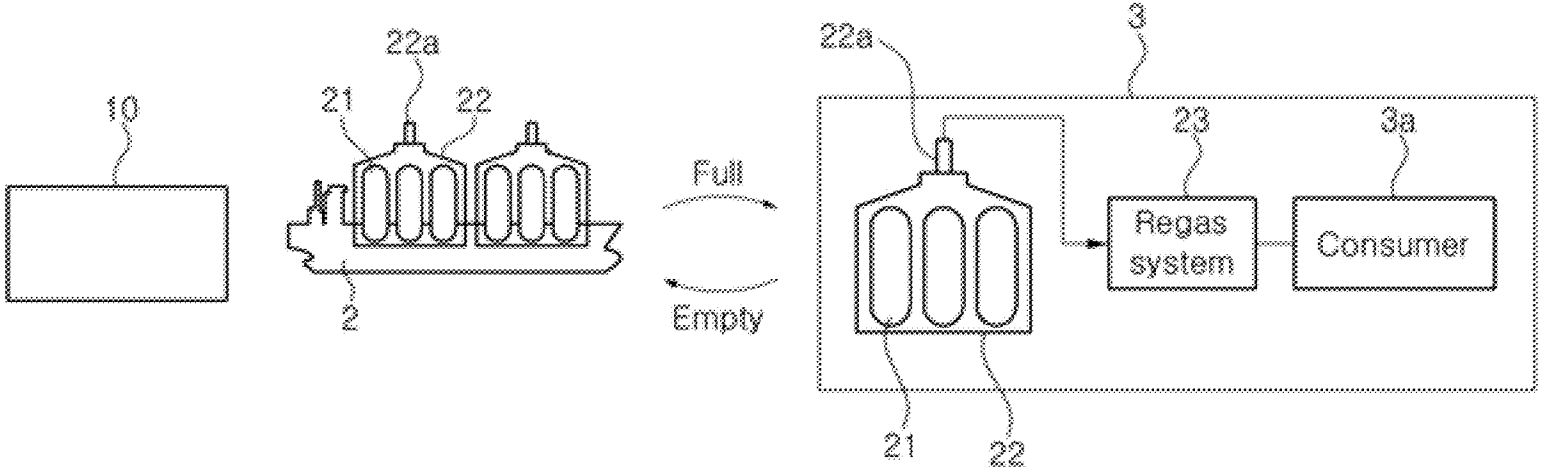
FIG. 6 is a configuration diagram explaining another example of the PLNG distributing method according to the present invention.

As shown in FIG. 6, in the transporting step S21, a container assembly 22 may be transported. The container assembly 22 is provided by combining a plurality of storage containers 21 as one package. The container assembly 22 may be provided with an integral nozzle 22*a* that is connected to integrate the nozzles (21*a* in FIG. 5), which are provided in the respective storage containers 21 in order for the inflow and outflow of the PLNG. Therefore, by grouping the storage containers 21 into the container assembly 22 and using the storage containers 21 as a single container by the integral nozzle 22*a*, it is possible to reduce time and effort necessary for the loading in the transporting step S21, the unloading in the unloading step S22, the connection to the regasification system 23 in the connecting step S23, and the collection in the collecting step S24.

The container assembly 22 is constructed by a plurality of storage containers 21. Thus, it is efficient to unload the container assembly 22 at a place where a large amount of natural gas is needed, like a single consumption place such as a power plant or an industrial complex.

In addition, according to the PLNG distributing method according to the present invention, a separate storage tank is not needed at the consumption place. Furthermore, the regasification system simply needs to be provided, and it is possible to unload the storage container 21 or the container assembly 22 and to collect the empty storage container 21 or the container assembly 22, while making the rounds from the place, where the PLNG production system is located, to the individual consumption places 3 by the vessel or the land vehicle parallel with the vessel. In particular, in the case of Southeast Asia where a plurality of small and medium consumption places are dispersed in many islands, it is possible to minimize the construction of infrastructures, such separate storage facilities and pipelines, at the respective consumption places.

Figure 7:
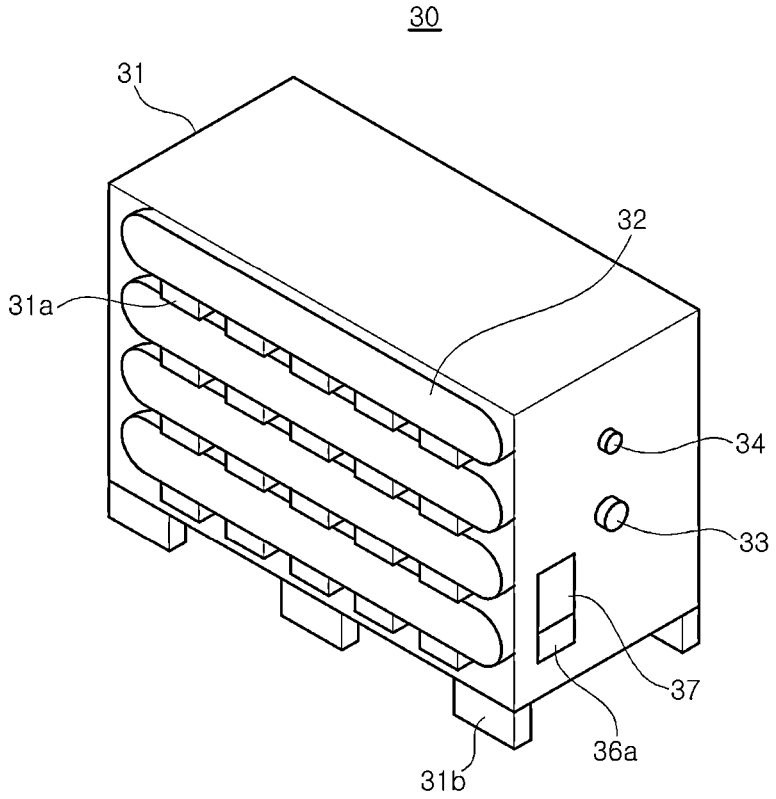
FIG. 7 is a perspective view showing an LNG storage tank according to the present invention.

FIG. 7 is a perspective view showing an LNG storage tank according to the present invention.

As shown in FIG. 7, the LNG storage tank 30 according to the present invention includes a plurality of storage containers 32 installed inside a main body 31 to store LNG. The LNG storage tank 30 allows the LNG to be loaded into and unloaded from the respective storage containers 32 through an unloading/loading line 33, to which the respective storage containers 32 are connected and in which loading/unloading valves 33*a* and 33*b* are installed.

The main body 31 is installed such that the plurality of storage containers 32 are arranged inside. The main body 31 may include spacers 31*a* installed between the storage containers 32 such that the storage containers 32 maintain the arrangement state while being kept spaced apart from one another.

In addition, the main body 31 may include a heat insulation layer for blocking heat transfer, or a dual structure for heat insulation. The main body 31 may have various structures, including a hexahedral structure like in this embodiment. In addition, the main body 31 may include a plurality of supports 31*b*, such that the main body 31 is spaced apart from the ground to block heat transfer to the ground, and the main body 31 is installed on the ground in a stable posture.

Figure 8:
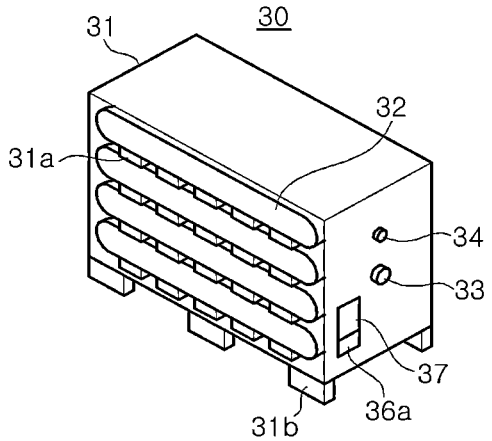
FIG. 8 is a perspective view showing various types of the LNG storage tank according to the present invention.
Figure 8:
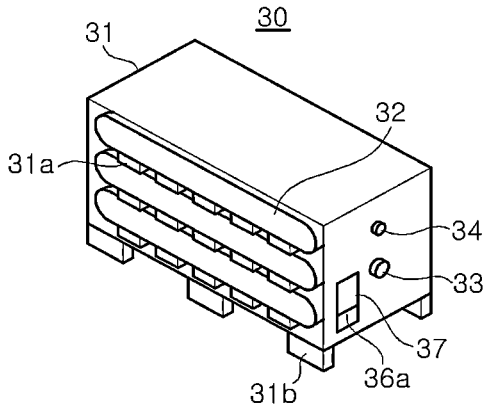
Figure 8:
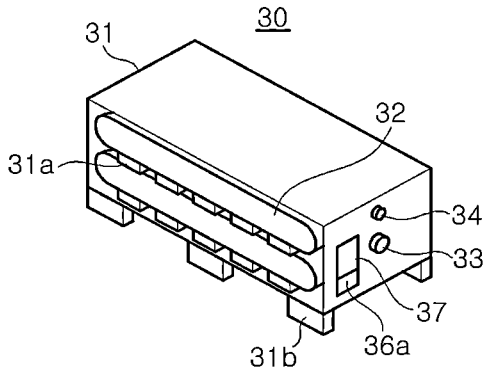

As shown in FIGS. 8(*a*), 8(*b*) and 8(*c*), the main body 31 may have a small size, a medium size, and a large size. Thus, the number and size of the storage containers 32 accommodated in the main body 31 may be standardized. However, the present invention is not limited the above examples. The main body 31 may be manufactured to accommodate various numbers of the storage containers 32 and may be manufactured in various sizes.

The storage containers 32 may be constructed and made of a material such that it can withstand a pressure of 13 to 25 bar and a temperature of −120 to −95° C., together with the loading/unloading line 33, so as to store the LNG. In order to withstand the above pressure and temperature condition, a heat insulation member is installed in the storage containers 32 and the loading/unloading line 33, and the storage containers 32 and the loading/unloading line 33 have a dual structure. Therefore, it is possible to store and transport the PLNG having a pressure of 13 to 25 bar and a temperature of −120 to −95° C., for example, a pressure of 17 bar and a temperature of −115° C.

Figure 9:
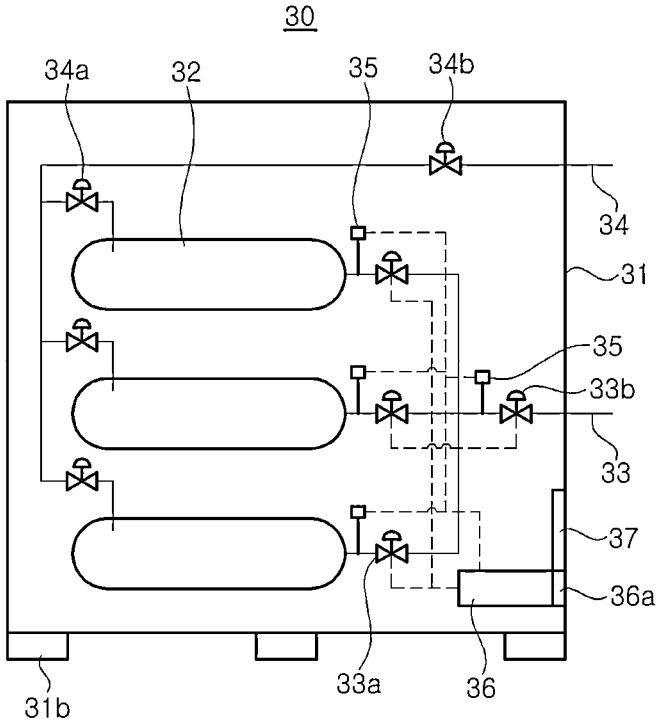
FIG. 9 is a configuration diagram showing one example of the LNG storage tank according to the present invention.

As shown in FIG. 9, the loading/unloading line 33 is connected to the respective storage containers 32 and extends to the outside of the main body 31. In the loading/unloading line 33, the loading/unloading valves 33*a* and 33*b* are installed to enable and disable the loading/unloading of the LNG into/from the storage containers 32. Therefore, after the main body 31 is installed at the consumption place and then the loading/unloading line 33 is connected to the regasification system or the supply line of the consumption place, the LNG or natural gas can be supplied immediately.

The loading/unloading valves 33*a* and 33*b* may include first individual valves 33*a* and a first integral valve 33*b*. The first individual valves 33*a* are individually installed to enable and disable the loading/unloading of the LNG into/from the storage containers 32. The first integral valve 33*b* is installed to integrally enable and disable the loading/unloading of the LNG into/from the entire storage containers 32. If all the first individual valves 33*a* as the loading/unloading valves are opened, the respective storage containers 32 may be packaged as a single container and used as a single tank. In addition, only the first individual valves 33*a* or only the first integral valve 33*b* may be installed as the loading/unloading valves.

The LNG storage tank 30 according to the present invention may further include a boil-off gas (BOG) line 34 in order to exhaust BOG that is naturally generated from the storage containers 32. The BOG line 34 is connected to some or all of the storage containers 32 and extends to the outside of the main body 31. The BOG line 34 is provided with BOG valves 34*a* and 34*b* that are opened and closed to exhaust the BOG generated within the storage containers 32. The BOG line 34 may be constructed and made of a material such that it can withstand a pressure of 13 to 25 bar and a temperature of −120 to −95° C.

In addition, the BOG valves 34*a* and 34*b* may include second individual valves 34*a* and a second integral valve 34*b*.

The second individual valves 34*a* are individually installed to enable and disable the exhaust of the BOG from the respective storage containers 32. The second integral valve 34*b* is installed to integrally enable and disable the exhaust of the BOG from the entire storage containers 32. Only the second individual valves 34*a* or only the second integral valve 34*b* may be installed as the BOG valves. As described above, if all the second individual valves 34*a* are opened, the respective storage containers 32 may be packaged as a single container and used as a single tank. In addition, only the second individual valves 34*a* or only the second integral valve 34*b* may be installed.

The LNG storage tank 30 according to the present invention may further include pressure sensing units 35 and a controlling unit 36. The pressure sensing units 35 sense an individual or entire internal pressure of the storage containers 32 and output a sense signal. The controlling unit 36 receives the sense signal output from the pressure sensing units 35, and displays the individual or entire internal pressure of the storage containers 32 on a displaying unit 37 installed on the outside of the main body 31. In order to measure the individual or entire internal pressure of the storage containers 32, the pressure sensing units 35 may be installed at the front ends of the storage containers 32 on the loading/unloading line 33, or may be installed on an integral path that is moving so as to load/unload the LNG through the loading/unloading line 33. In addition, the controlling unit 36 may control the loading/unloading valves 33*a* and 33*b* and the BOG valves 34*a* and 34*b* according to a manipulation signal output from a manipulating unit 36*a*, which is installed in the main body 31 or installed to enable a wired/wireless communication at a remote place.

Figure 10:
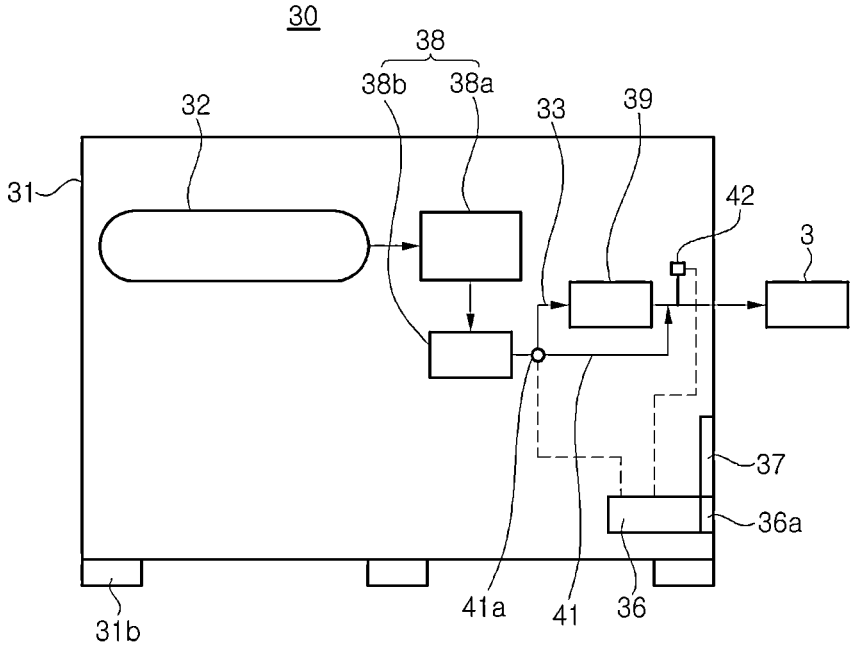
FIG. 10 is a configuration diagram showing another example of the LNG storage tank according to the present invention.

As shown in FIG. 10, the LNG storage tank 30 according to the present invention may include a heating unit 38 and a heating value adjusting unit 39 so as to vaporize the LNG unloaded from the storage containers 32 and to adjust a heating value required at a consumption place. The heating unit 38 is installed to vaporize the LNG unloaded from some or all of the storage containers 32. The heating value adjusting unit 39 is installed to adjust a heating value of the natural gas passing through the heating unit 38. The heating unit 38 and the heating value adjusting unit 39 may be installed on a line where any one or a plurality of the storage containers 32 are integrated in the loading/unloading line 33, or may be installed on a separate line that is connected to the storage containers 32 and the loading/unloading line 33 and passes the LNG by a valve.

The heating unit 38 may include a plate-fin type heat exchanger 38*a* and an electric heater 38*b*. The plate-fin type heat exchanger 38*a* is installed to primarily heat the LNG by heat exchange with air. The electric heater 38*b* is installed to secondarily heat the LNG that is vaporized by passing the heat exchanger 38*a*.

A bypass valve 41 may be further provided in the line where the heating value adjusting unit 39 is installed, for example, the loading/unloading line 33. The bypass line 41 is connected to bypass the heating value adjusting unit 39 by a bypass valve 41*a*. Therefore, when it is necessary to adjust the heating value of the natural gas, the natural gas is supplied to the heating value adjusting unit 39 by the operation of the bypass valve 41*a*. In this manner, the natural gas having the heating value required at the consumption place is supplied. When it is unnecessary to adjust the heating value of the natural gas, the natural gas bypasses the heating value adjusting unit 39 through the bypass line 41 by the operation of the bypass valve 41*a*. The bypass valve 41*a* may be a three-way valve or a plurality of two-way valves.

In addition, the LNG storage tank 30 according to the present invention may further include a temperature sensing unit 42 and a controlling unit 36 so as to make the unloaded natural gas have a temperature required at the consumption place. The temperature sensing unit 42 senses a temperature of the unloaded natural gas. The controlling unit 36 receives a signal from the temperature sensing unit 42, and controls the electric heater 38*b* to make the natural gas reach a set temperature range. In addition, the controlling unit 36 may display the temperature of the unloaded natural gas on the displaying unit 37 installed on the outside of the main body 31.

The temperature sensing unit 42 may be installed at an outlet side of the loading/unloading line 33. In addition, the controlling unit 36 may control the bypass valve 41*a* according to the manipulation signal output from the manipulating unit 36*a* as described above.

As such, the LNG storage tank 30 according to the present invention may be divided into the storage containers 32, which can store the LNG and process the BOG, and the storage containers 32, which can store the LNG, process the BOG, and adjust the vaporization facility and the heating value, depending on functions. The LNG storage tank 30 according to the present invention can easily transport the LNG or the natural gas according to a consumer's request at the consumption place.

Figure 11:
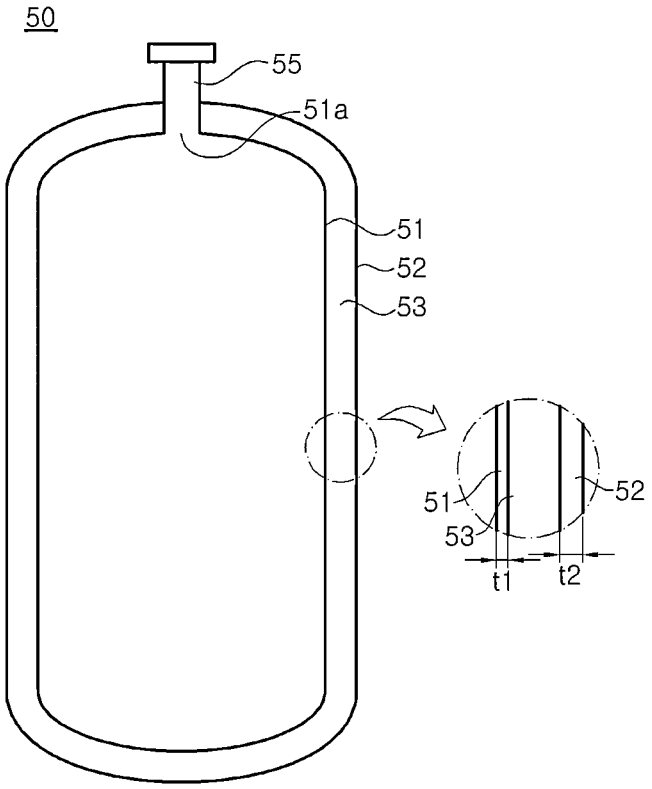
FIG. 11 is a sectional view showing an LNG storage container according to a first embodiment of the present invention.

FIG. 11 is a sectional view showing an LNG storage container according to a first embodiment of the present invention.

As shown in FIG. 11, the LNG storage container 50 according to the first embodiment of the present invention may include an inner shell 51, an outer shell 52, and a heat insulation layer part 53. The inner shell 51 is made of a metal that withstands a low temperature of LNG stored inside. The outer shell 52 encloses the outside of the inner shell 51 and is made of a steel that withstands an internal pressure of the inner shell 51. The heat insulation layer part 53 reduces a heat transfer between the inner shell 51 and the outer shell 52.

The inner shell 51 forms an LNG storage space. The inner shell 51 may be made of a metal that withstands a low temperature of the LNG. For example, the inner shell 51 may be made of a metal having excellent low temperature characteristic, such as aluminum, stainless steel, and 5-9% nickel steel. Like in this embodiment, the inner shell 51 may be formed in a tubular type. Also, the inner shell 51 may have various shapes, including a polyhedron.

The outer shell 52 encloses the outside of the inner shell 51 such that a space is formed between the outer shell 52 and the inner shell 51. The outer shell 52 is made of a steel that withstands the internal pressure of the inner shell 51. The outer shell 52 shares the internal pressure applied to the inner shell 51. Therefore, an amount of a material used for the inner shell 51 may be reduced, leading to a reduction in the production costs of the LNG storage container 50.

Due to a connection passage to be described below, the pressure of the inner shell 51 becomes equal or similar to the pressure of the heat insulation layer part 53. Therefore, the outer shell 52 can withstand the pressure of the PLNG. Even though the inner shell 51 is manufactured to withstand a temperature of −120 to −95° C., the PLNG having the above pressure (13 to 25 bar) and temperature condition, for example, a pressure of 17 bar and a temperature of −115° C., can be stored by the inner shell 51 and the outer shell 52. The storage container 50 may be designed to satisfy the above pressure and temperature condition in such a state that the outer shell 52 and the heat insulation layer part 53 are assembled.

Meanwhile, the inner shell 51 may be made to have a thickness t1 smaller than a thickness t2 of the outer shell 52. Therefore, when manufacturing the inner shell 51, the use of expensive metal having excellent low temperature characteristic may be reduced.

The heat insulation layer part 53 is installed in a space between the inner shell 51 and the outer shell 52 and is made of a heat insulator that reduces a heat transfer. In addition, the heat insulation layer part 53 may be constructed or made of a material such that a pressure equal to the internal pressure of the inner shell 51 is applied thereto. The pressure equal to the internal pressure of the inner shell 51 refers to not a strictly equal pressure but a similar pressure.

The heat insulation layer part 53 and the inside of the inner shell 51 may be connected together by the connection passage 54 in order for pressure balance between the inside and the outside of the inner shell 51. When the pressure is balanced between the inside of the inner shell 51 and the outside of the inner shell 51 (the inside of the outer shell 52) by the connection passage 54, the outer shell 52 supports a considerable portion of the pressure, leading to a reduction in the thickness of the inner shell 51.

Figure 12:
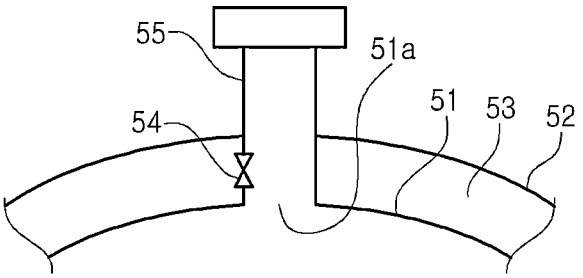
FIG. 12 is a sectional view showing another example of a connecting part of the LNG storage container according to the first embodiment of the present invention.

As shown in FIG. 12, the connection passage 54 may be formed at a side contacting the heat insulation layer part 53 in a connecting part 55 provided at an inlet/outlet port 51*a* of the inner shell 51. Therefore, the internal pressure of the inner shell 51 is moved toward the heat insulation layer part 53 through the connection passage 54, and thus, the pressure between the inside and the outside of the inner shell 51 is balanced.

Figure 13:
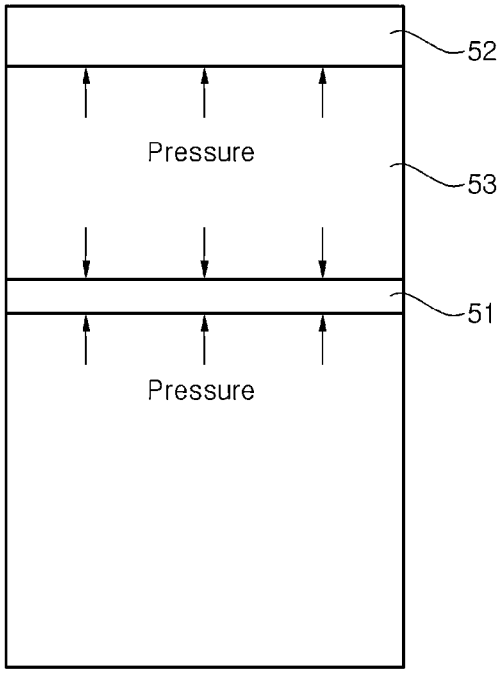
FIG. 13 is a sectional view explaining the operation of the LNG storage container according to the first embodiment of the present invention.

As shown in FIG. 13, the heat insulation layer part 53 is installed with a thickness to reduce a heat transfer between the inner shell 51 made of a metal having excellent low temperature characteristic and the outer shell 52 made of a steel having excellent strength and to maintain an appropriate boil off rate (BOR). Due to the installation of the heat insulation layer part 53, the PLNG as well as the LNG can be stored. Due to the pressure balance between the inside and the outside of the inner shell 51, the thickness t1 of the inner shell 51 is reduced. Therefore, the use of the expensive metal having excellent low temperature characteristic may be reduced. In addition, a structural defect caused by the internal pressure of the inner shell 51 may be prevented, and the storage container 50 having excellent durability may be provided.

Meanwhile, the connecting part 55 may be integrally connected to the inlet/outlet port 51*a* of the inner shell 51 in order for the supply and exhaust of the LNG to/from the inner shell 51. Thus, the connecting part 55 may protrude outside the outer shell 52. An external member such as a valve may be connected to the connecting part 55.

Figure 14:
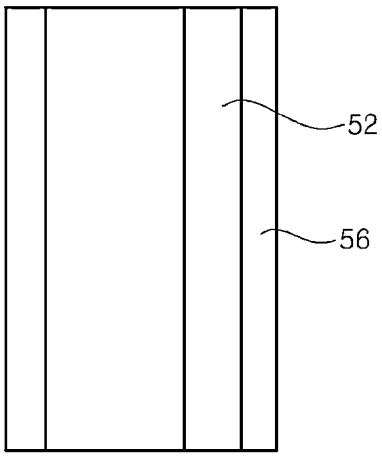
FIG. 14 is a partial sectional view showing an LNG storage container according to a second embodiment of the present invention.

As shown in FIG. 14, an LNG storage container according to a second embodiment of the present invention may include an external heat insulation layer 56 installed in order for a heat insulation on the outside of the outer shell 52. The external heat insulation layer 56 may be attached to the outer shell 52 such that it encloses the outside of the outer shell 52. Also, the external heat insulation layer 56 may keep enclosing the outer shell 52 by its molded or formed shape. Hence, a heat transfer from the exterior is prevented. Therefore, under a high temperature environment such as tropical regions, the generation of BOG from the LNG or PLNG stored in the storage containers is reduced.

Figure 15:
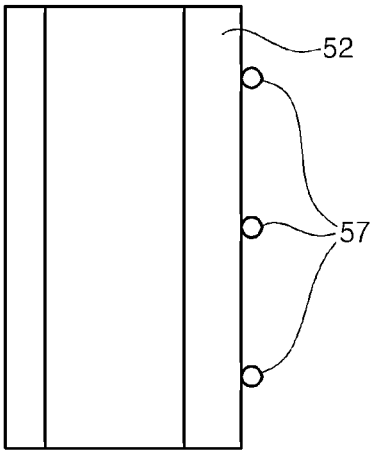
FIG. 15 is a partial sectional view showing an LNG storage container according to a third embodiment of the present invention.

As shown in FIG. 15, an LNG storage container according to a third embodiment of the present invention may include a heating member 57 installed on the outside of the outer shell 52. The heating member 57 may be a heat medium circulation line that supplies heat to the outer shell 52 by the circulating supply of heat medium. The heating member 57 may include a heater that generates heat by power supplied from a battery, an electric condenser or a power supply unit attached to the storage container 50. The heating member 57 may include a flexible plate-type heating element or a heating wire wound around the outer surface of the outer shell 52 as in the case of this embodiment.

Therefore, under a low temperature environment such as polar regions, the LNG or PLNG stored in the storage container is not affected by external cold air. Hence, the outer shell 52 may be made of a general steel sheet, reducing the manufacturing costs thereof.

Figure 16:
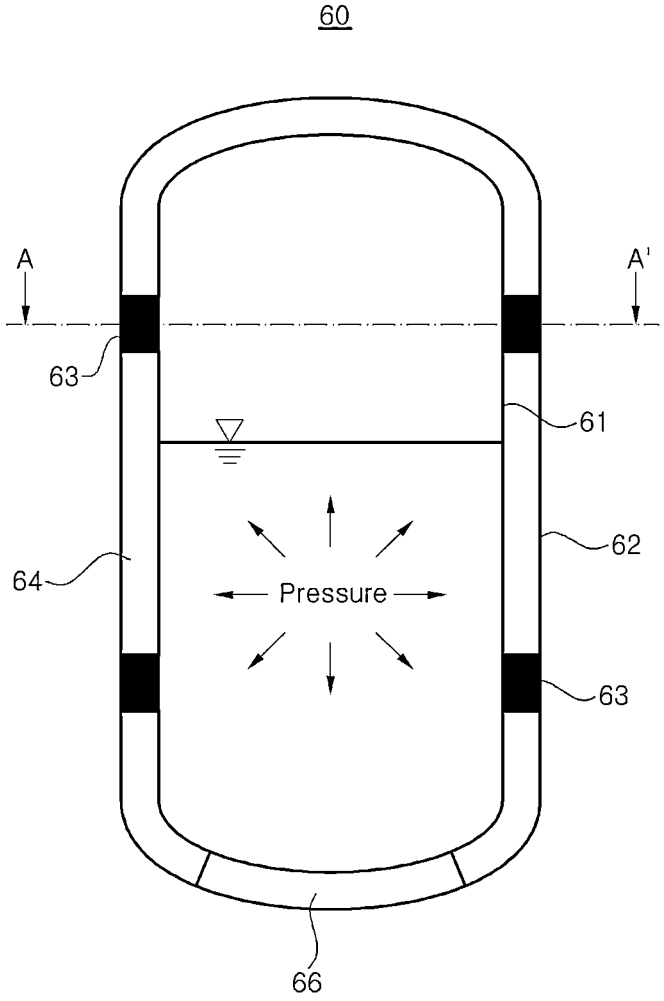
FIG. 16 is a sectional view showing an LNG storage container according to a fourth embodiment of the present invention.

FIG. 16 is a sectional view showing an LNG storage container according to a fourth embodiment of the present invention. As shown in FIG. 16, the LNG storage container 60 according to the fourth embodiment of the present invention may include an inner shell 61, an outer shell 62, a support 63, and a heat insulation layer part 64. The inner shell 61 stores LNG inside, and the outer shell 62 encloses the outside of the inner shell 61. The support 63 is installed between the inner shell 61 and the outer shell 62, and supports the inner shell 61 and the outer shell 62. The heat insulation layer part 64 reduces a heat transfer. Meanwhile, a connecting part (not shown) may be integrally connected to an inlet/outlet port of the inner shell 61 in order for the supply and exhaust of the LNG to/from the inner shell 61. Thus, the connecting part may protrude outside the outer shell 62. An external member such as a valve may be connected to the connecting part.

The inner shell 61 forms an LNG storage space. The inner shell 61 may be made of a metal that withstands a low temperature of the LNG. For example, the inner shell 61 may be made of a metal having excellent low temperature characteristic, such as aluminum, stainless steel, and 5-9% nickel steel. Like in this embodiment, the inner shell 61 may be formed in a tubular type. Also, the inner shell 61 may have various shapes, including a polyhedron.

The outer shell 62 encloses the outside of the inner shell 61 such that a space is formed between the outer shell 62 and the inner shell 61. The outer shell 62 is made of a steel that withstands the internal pressure of the inner shell 61. The outer shell 62 shares the internal pressure applied to the inner shell 61. Therefore, an amount of a material used for the inner shell 61 may be reduced, leading to a reduction in the production costs of the LNG storage container 60.

Due to a connection passage, the pressure of the inner shell 61 becomes equal or similar to the pressure of the heat insulation layer part 64. Therefore, the outer shell 62 can withstand the pressure of the PLNG. Even though the inner shell 61 is manufactured to withstand a temperature of −120 to −95° C., the PLNG having the above pressure (13 to 25 bar) and temperature condition, for example, a pressure of 17 bar and a temperature of −115° C., can be stored by the inner shell 61 and the outer shell 62. The storage container 60 may be designed to satisfy the above pressure and temperature condition in such a state that the outer shell 62, the support 63, and the heat insulation layer part 64 are assembled.

Figure 17:
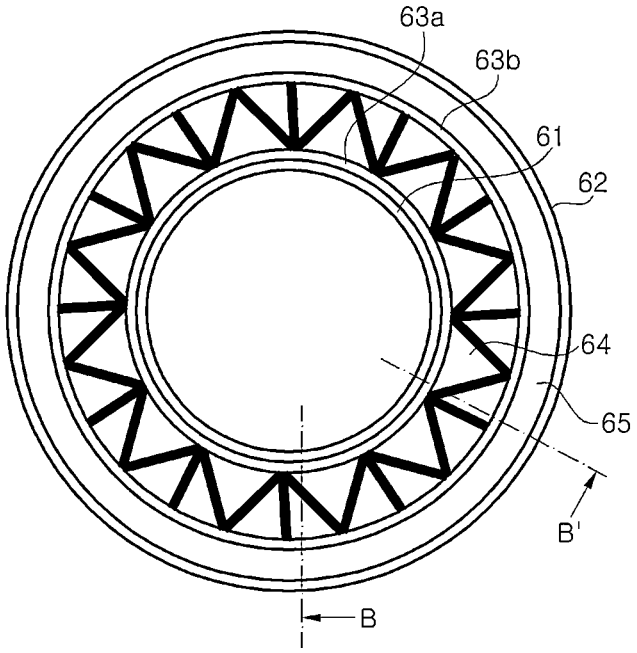
FIG. 17 is a sectional view taken along line A-A' of FIG. 16.

The support 63 is installed in a space between the inner shell 61 and the outer shell 62 in order to support the inner shell 61 and the outer shell 62. The support 63 structurally reinforces the inner shell 61 and the outer shell 62. The support 63 may be made of a metal (e.g., a low temperature steel) that withstands a low temperature of the LNG. As shown in FIG. 17, a single support 63 may be installed along lateral circumferences of the inner shell 61 and the outer shell 62, or a plurality of supports 63 may be installed to be spaced apart in a vertical direction on the lateral sides of the inner shell 61 and the outer shell 62 as in the case of this embodiment.

Figure 18:
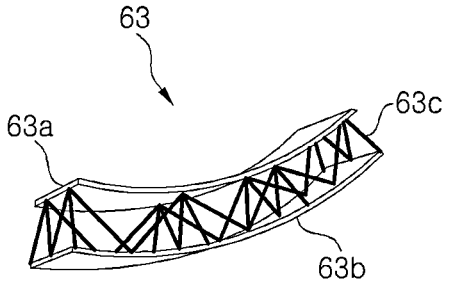
FIG. 18 is a sectional view taken along line B-B' of FIG. 17.

As shown in FIG. 18, the support 63 may include a first flange 63*a*, a second flange 63*b*, and a first web 63*c*. The first flange 63*a* and the second flange 63*b* are supported on the outer surface of the inner shell 61 and the inner surface of the outer shell 62. The first web 63*c* is provided between the first flange 63*a* and the second flange 63*b*. The first flange 63*a* and the second flange 63*b* may have a ring shape or may include curvature members formed by dividing a ring shape into a plurality of parts.

In addition, the support 63 may be fixedly supported by welding on the outer surface of the inner shell 61 and the inner surface of the outer shell 62, without using separate members such as a flange. In this case, a glass fiber may be inserted into the support 63 in order to prevent heat from being transferred to the exterior through the support 63.

The first web 63*c* may be a plurality of gratings, both ends of which are fixed to the first flange 63*a* and the second flange 63*b*. Some of the gratings may be fixed to receives and apply a compressive force between the first flange 63*a* and the second flange 63*b*, and the others may be fixed to form a truss structure. The shape and the fixing position of the gratings may be changed or adjusted. This may be equally applied to a case that the first web 63*c* is fixedly supported by welding on the inner shell 61 and the outer shell 62.

A heat insulation member 65 may be installed between the inner surface of the outer shell 62 and the second flange 63*b* in order for blocking a heat transfer. The heat insulation member 65 may include a glass fiber and prevent the temperature of the inner shell 61 from being transferred to the outer shell 62 by the support 63.

In addition, in the case that the support 63 is fixedly supported by welding, the heat insulation member 65 such a glass fiber may be disposed at an end portion of the support 63 contacting the outer shell 62 and be fixed by welding. Alternatively, a separate heat insulation member may be disposed between the outside of the support 63 and the inside of the outer shell 62. In this manner, it is possible to prevent the temperature of the inner shell 61 from being transferred to the outer shell 62 by the support 63.

The LNG storage container 60 according to the present invention may further include a lower support 66 installed in a lower space between the inner shell 61 and the outer shell 62 in order to support the inner shell 61 and the outer shell 62. The lower support 66 may include a third flange, a fourth flange, and a second web. The third flange and the fourth flange are supported on the outer surface of the inner shell 61 and the inner surface of the outer shell 62. The second web is provided between the third flange and the fourth flange. The second web may include a plurality of gratings, both of which are fixed to the third flange and the fourth flange. Detailed shapes of these components are just different according to the installation positions, and these components of the lower support are substantially identical to those of the support 63. In addition, a heat insulation member (not shown) may be installed between the inner surface of the outer shell 62 and the fourth flange in order for blocking a heat transfer. The heat insulation member may be a glass fiber.

The heat insulation layer part 64 is installed in a space between the inner shell 61 and the outer shell 62 and is made of a heat insulator that reduces a heat transfer. In addition, the heat insulation layer part 64 may be constructed or made of a material such that a pressure equal to the internal pressure of the inner shell 61 is applied thereto. The pressure equal to the internal pressure of the inner shell 61 refers to not a strictly equal pressure but a similar pressure. In addition, the heat insulation layer part 64 and the inside of the inner shell 61 may be connected together by the connection passage (54 in FIG. 12) in order for pressure balance between the inside and the outside of the inner shell 61, like in the previous embodiment shown in FIG. 12. Since the connection passage 54 has been described in detail in the previous embodiment, further description thereof will be omitted.

In addition, the heat insulation layer part 64 may be made of a grain-type insulator (e.g., perlite) that can pass through the support 63, in particular, the web 63*c* having the grating structure. Therefore, the grain-type heat insulation layer part 64 can be freely mixed uniformly and filled. Since no gap is formed between the inner shell 61 and the outer shell 62, the heat insulation performance may be improved.

Furthermore, upon filling, grains of the heat insulation layer part 64 are freely moved by the support 63 and the lower support 66 having the grating support structure, thereby preventing non-uniformity of the heat insulation layer part 64.

Figure 19:
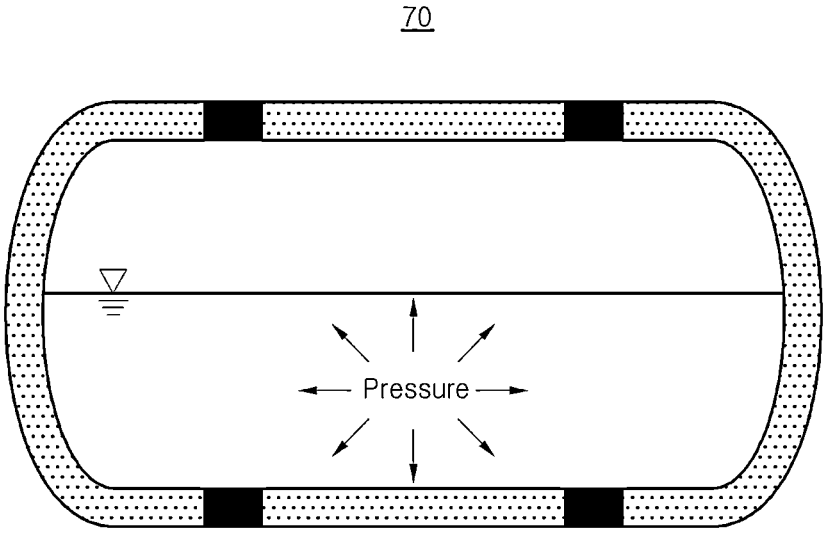
FIG. 19 is a sectional view showing an LNG storage container according to a fifth embodiment of the present invention.

As shown in FIG. 19, an LNG storage container 70 according to a fifth embodiment of the present invention may be installed in a transverse direction. In this case, the lower support (66 in FIG. 16) in the previous embodiment may be omitted.

Figure 20:
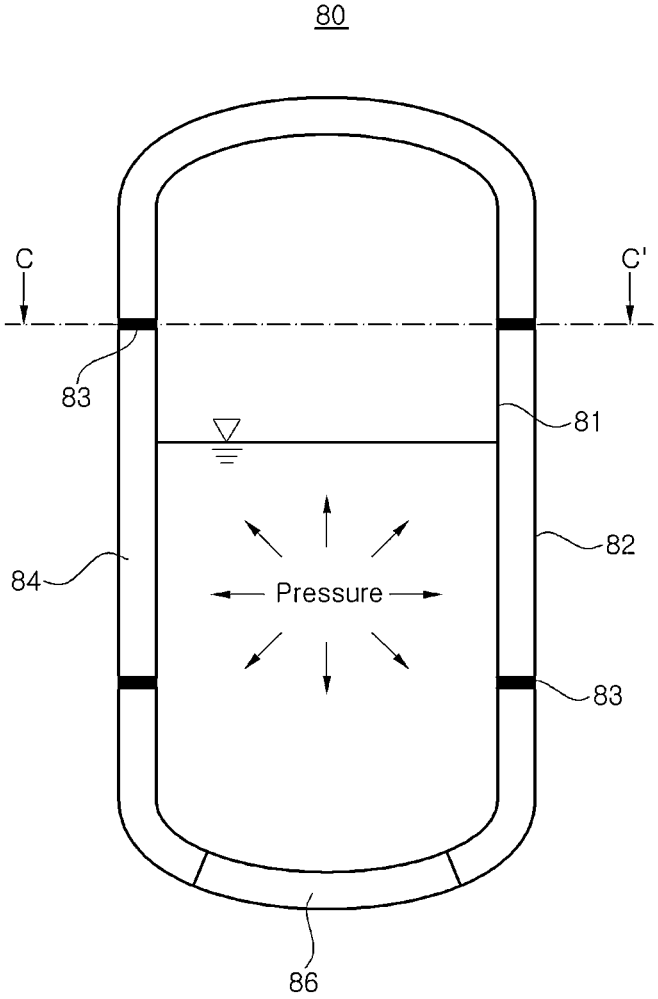
FIG. 20 is a sectional view showing an LNG storage container according to a sixth embodiment of the present invention.

FIG. 20 is a sectional view showing an LNG storage container according to a sixth embodiment of the present invention.

As shown in FIG. 12, the LNG storage container 80 according to the sixth embodiment of the present invention may include an inner shell 81, an outer shell 82, and a heat insulation layer part 84. The inner shell 81 stores LNG inside, and the outer shell 82 encloses the outside of the inner shell 81. The heat insulation layer part 84 reduces a heat transfer between the inner shell 81 and the outer shell 82. The outer surface of the inner shell 81 and the inner surface of the outer shell 82 are connected together by a metal core 83. Meanwhile, a connecting part (not shown) may be integrally connected to an inlet/outlet port of the inner shell 81 in order for the supply and exhaust of the LNG to/from the inner shell 81. Thus, the connecting part may protrude outside the outer shell 82. An external member such as a valve may be connected to the connecting part.

The inner shell 81 forms an LNG storage space. The inner shell 81 may be made of a metal that withstands a low temperature of the LNG. For example, the inner shell 81 may be made of a metal having excellent low temperature characteristic, such as aluminum, stainless steel, and 5-9% nickel steel. Like in this embodiment, the inner shell 81 may be formed in a tubular type. Also, the inner shell 81 may have various shapes, including a polyhedron.

The outer shell 82 encloses the outside of the inner shell 81 such that a space is formed between the outer shell 82 and the inner shell 81. The outer shell 82 is made of a steel that withstands the internal pressure of the inner shell 81. The outer shell 82 shares the internal pressure applied to the inner shell 81. Therefore, an amount of a material used for the inner shell 81 may be reduced, leading to a reduction in the production costs of the LNG storage container 80.

Due to a connection passage, the pressure of the inner shell 81 becomes equal or similar to the pressure of the heat insulation layer part 84. Therefore, the outer shell 82 can withstand the pressure of the PLNG. Even though the inner shell 81 is manufactured to withstand a temperature of −120 to −95° C., the PLNG having the above pressure (13 to 25 bar) and temperature condition, for example, a pressure of 17 bar and a temperature of −115° C., can be stored by the inner shell 81 and the outer shell 82. The storage container 80 may be designed to satisfy the above pressure and temperature condition in such a state that the outer shell 82, the metal core 83, and the heat insulation layer part 84 are assembled.

The metal core 83 may be connected to the outer surface of the inner shell 81 and the inner surface of the outer shell 82 such that the inner shell 81 and the outer shell 82 are supported each other. The metal core 83 may be installed along the lateral circumferences of the inner shell 81 and the outer shell 82, or a plurality of supports 63 may be installed to be spaced apart in a vertical direction on the lateral sides of the inner shell 81 and the outer shell 82 as in the case of this embodiment. In addition, the metal core 83 may be a wire such as a steel wire. For example, the metal core 83 may be connected to a plurality of rings provided on the outer surface of the inner shell 81 and the inner surface of the outer shell 82. The metal core 83 may be coupled or welded on a plurality of support points 83*a*. Also, the metal core 83 may connect the inner shell 81 and the outer shell 82 by various methods.

Figure 21:
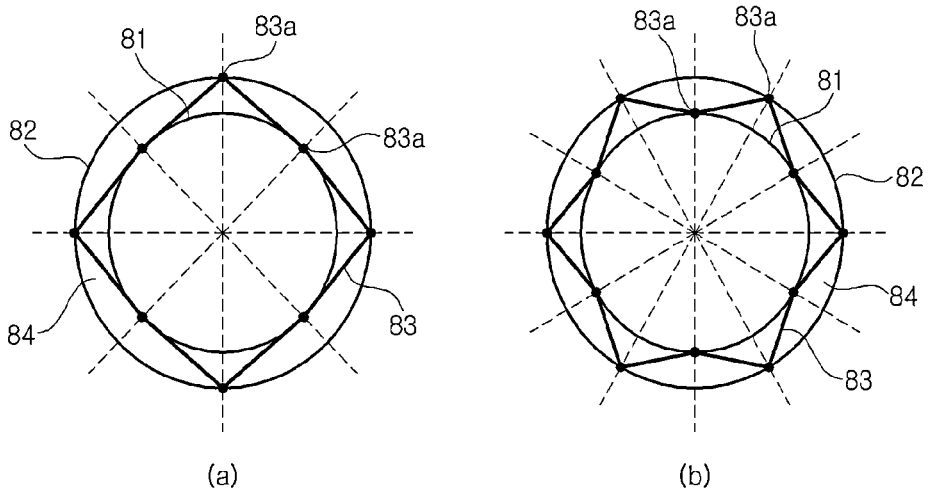
FIG. 21 is a sectional view taken along line C-C' of FIG. 20.

As shown in FIG. 21, the metal core 83 may be installed by repeatedly connecting one support point 83*a* to two adjacent support points 83*a* of the outer shell 82 and repeatedly connecting one support point 83*a* of the outer shell 82 to two adjacent support points 83*a* of the inner shell 81. The metal core 83 may be arranged in a zigzag form along the circumferences of the inner shell 81 and the outer shell 82. As shown in FIGS. 8(*a*) and 8(*b*), the number of times of connections of the metal core 83 and the number of the metal core 83 may be changed.

The LNG storage container 80 according to the present invention may further include a lower support 86 installed in a lower space between the inner shell 81 and the outer shell 82 in order to support the inner shell 81 and the outer shell 82. The lower support 86 may include flanges and a web. The flanges are supported on the outer surface of the inner shell 81 and the inner surface of the outer shell 82. The web is provided between the flanges. The web may include a plurality of gratings, both of which are fixed to the flanges. Since these components are substantially identical to the lower support 66 of the LNG storage container 60 according to the fifth embodiment of the present invention, a detailed description thereof will be omitted.

The heat insulation layer part 84 is installed in a space between the inner shell 81 and the outer shell 82 and is made of a heat insulator that reduces a heat transfer. In addition, the heat insulation layer part 84 may be constructed or made of a material such that a pressure equal to the internal pressure of the inner shell 81 is applied thereto. The pressure equal to the internal pressure of the inner shell 81 refers to not a strictly equal pressure but a similar pressure. The heat insulation layer part 84 and the inner shell 81 may be connected together by the connection passage (54 in FIG. 12) in order for pressure balance between the inside and the outside of the inner shell 81, like in the previous embodiment shown in FIG. 12. Since the connection passage 54 has been described in detail in the previous embodiment, further description thereof will be omitted.

The heat insulation layer part 84 may be made of a grain-type insulator that can pass through the metal core 83. Therefore, the grain-type heat insulation layer part 84 can be freely mixed uniformly and filled. Since no gap is formed between the inner shell 81 and the outer shell 82, the non-uniformity of the heat insulation layer part 84 may be prevented and the heat insulation performance may be improved.

Figure 22:
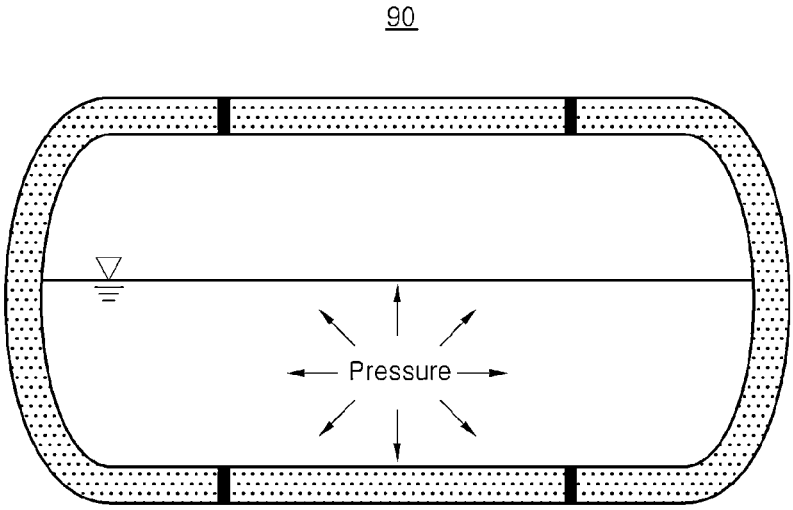
FIG. 22 is a sectional view showing an LNG storage container according to a seventh embodiment of the present invention.

As shown in FIG. 22, the LNG storage container 90 according to the present invention may be installed in a transverse direction. In this case, the lower support (86 in FIG. 20) may be omitted.

Figure 23:
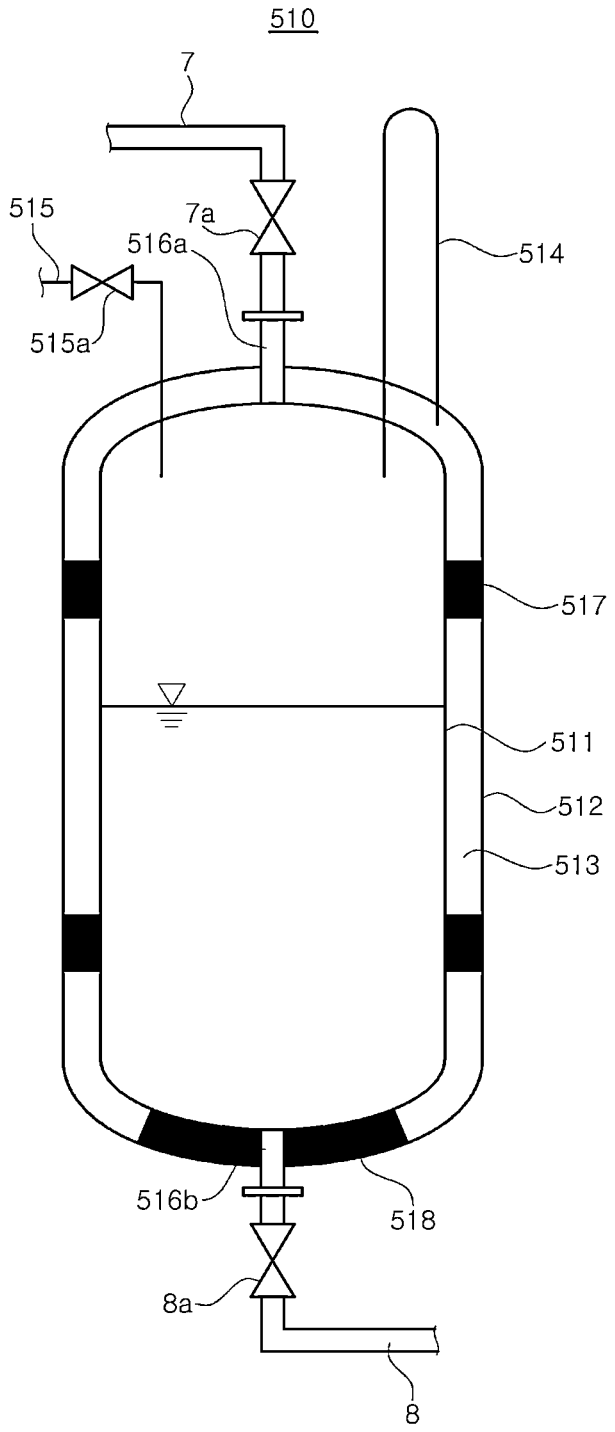
FIG. 23 is a configuration diagram showing an LNG storage container according to an eighth embodiment of the present invention.

FIG. 23 is a configuration diagram showing an LNG storage container according to an eighth embodiment of the present invention.

As shown in FIG. 23, the LNG storage container 510 according to the eighth embodiment of the present invention may include an inner shell 511 and an outer shell 512. The inner shell 511 stores LNG inside, and the outer shell 512 encloses the outside of the inner shell 512. An inner space of the inner shell 511 and a space between the inner shell 511 and the outer shell 512 are connected together by an equalizing line 514. In addition, a heat insulation layer part 513 may be installed between the inner shell 511 and the outer shell 512.

The inner shell 511 forms an LNG storage space. The inner shell 511 may be made of a metal that withstands a low temperature of the LNG. For example, the inner shell 511 may be made of a metal having excellent low temperature characteristic, such as aluminum, stainless steel, and 5-9% nickel steel. Like in this embodiment, the inner shell 511 may be formed in a tubular type. Also, the inner shell 511 may have various shapes, including a polyhedron.

Due to a connection passage, the pressure of the inner shell 511 becomes equal or similar to the pressure of the heat insulation layer part 513. Therefore, the outer shell 512 can withstand the pressure of the PLNG. Even though the inner shell 511 is manufactured to withstand a temperature of −120 to −95° C., the PLNG having the above pressure (13 to 25 bar) and temperature condition, for example, a pressure of 17 bar and a temperature of −115° C., can be stored by the inner shell 511 and the outer shell 512. The storage container 510 may be designed to satisfy the above pressure and temperature condition in such a state that the outer shell 512 and the heat insulation layer part 513 are assembled.

A first exhaust line 515 may be connected to the upper inner space of the inner shell 511 and extend to the exterior. A first exhaust valve 515*a* is installed in the first exhaust line 515 to open/close a gas flow. Therefore, the first exhaust line 515 may exhaust gas from the inner space of the inner shell 511 to the exterior by opening the first exhaust valve 515*a*.

In addition, first and second connecting parts 516*a* and 516*b* may be connected to the upper inner space and the lower inner space of the inner shell 511, pass through the outer shell, and extend to the exterior. Therefore, LNG may be loaded into the inside of the inner shell 511 through a loading line 7 connected to the first connecting part 516*a*, and LNG may be unloaded from the inside of the inner shell 511 through an unloading line 8 connected to the second connecting part 516*b*. Meanwhile, valves 7*a* and 8*b* may be installed in the loading line 7 and the unloading line 8, respectively.

The outer shell 512 encloses the outside of the inner shell 511 such that a space is formed between the outer shell 512 and the inner shell 511. The outer shell 512 is made of a steel that withstands the internal pressure of the inner shell 511. The outer shell 512 shares the internal pressure applied to the inner shell 511. Therefore, an amount of a material used for the inner shell 511 may be reduced, leading to a reduction in the production costs of the LNG storage container 510.

Meanwhile, the inner shell 511 may be formed to have a thickness smaller than that of the outer shell 512. Hence, when manufacturing the storage container 510, the use of an expensive metal having excellent low temperature characteristic may be reduced.

The heat insulation layer part 513 is installed in a space between the inner shell 511 and the outer shell 512 and is made of a heat insulator that reduces a heat transfer. In addition, the heat insulation layer part 513 may be constructed or made of a material such that a pressure equal to the internal pressure of the inner shell 511 is applied thereto.

The equalizing line 514 connects the inner space of the inner shell 511 and the space between the inner shell 511 and the outer shell 512. As a result, the inner space and the outer space of the inner shell 511 are connected together. Hence, a difference between the internal pressure of the inner shell 511 and the pressure between the inner shell 511 and the outer shell 512 is minimized, thereby achieving the pressure balance. By minimizing the pressure difference between the inside and the outside of the inner shell 511, the pressure imposed on the inner shell 511 is reduced. Therefore, the thickness of the inner shell 511 may be reduced, and the use of an expensive metal having excellent low temperature characteristic may be reduced. Also, a structural defect caused by the internal pressure of the inner shell 511 may be prevented, and the storage container 510 having excellent durability may be provided.

A support 517 may be installed in a space between the inner shell 511 and the outer shell 512 in order to support the inner shell 511 and the outer shell 512. The support 517 structurally reinforces the inner shell 511 and the outer shell 512. The support 517 may be made of a metal that withstands a low temperature of the LNG. A single support 517 may be installed along lateral circumferences of the inner shell 511 and the outer shell 512, or a plurality of supports 517 may be installed to be spaced apart in a vertical direction on the lateral sides of the inner shell 511 and the outer shell 512 as in the case of this embodiment.

In addition, a lower support 518 may be installed in a lower space between the inner shell 511 and the outer shell 512 in order to support the inner shell 511 and the outer shell 512.

Like the support 63 shown in FIG. 18, the support 517 and the lower support 518 may include flanges and a web. The flanges are supported on the outer surface of the inner shell 511 and the inner surface of the outer shell 512. The web is provided between the flanges. The web may include a plurality of gratings, both of which are fixed to the flanges. A heat insulation member such as a glass fiber may be installed between the outer shell 512 and the flanges in order for blocking a heat transfer. In addition, like the metal core 83 shown in FIG. 20, the support 517 may be connected to the outer surface of the inner shell 511 and the inner surface of the outer shell 512 such that the inner shell 511 and the outer shell 512 are supported each other.

Figure 24:
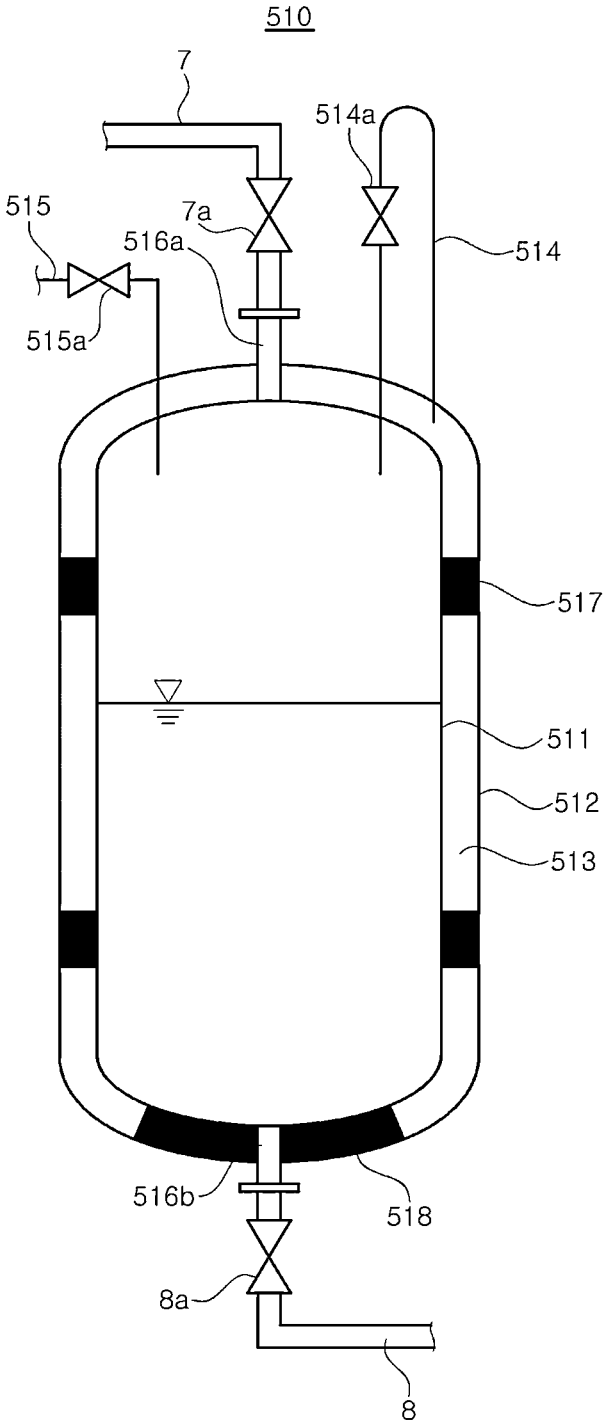
FIG. 24 is a configuration diagram showing an LNG storage container according to a ninth embodiment of the present invention.

As shown in FIG. 24, an LNG storage container according to a ninth embodiment of the present invention may include an on/off valve 514*a* for opening/closing a flow of a liquid, e.g., natural gas or BOG, to the equalizing line 514. Therefore, the liquid flow through the equalizing line 514 may be blocked by the on/off valve 514*a*, depending on a change in the position or posture of the storage container.

Figure 25:
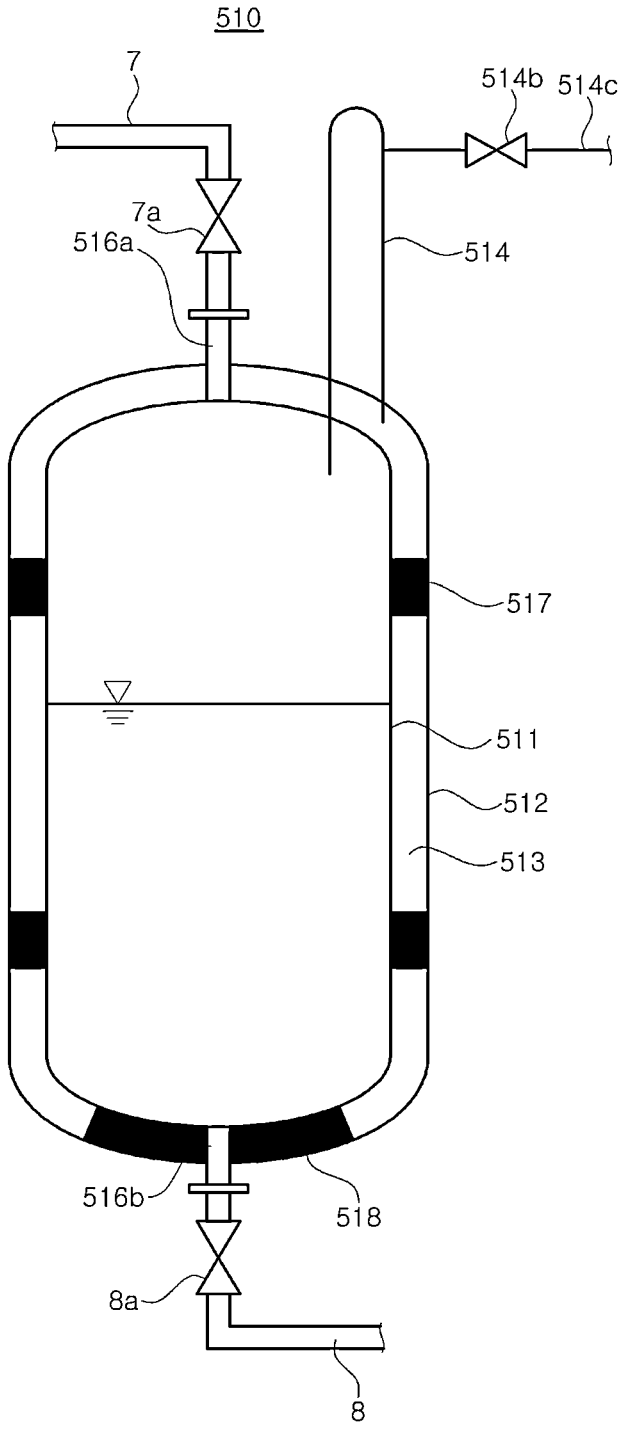
FIG. 25 is a configuration diagram showing an LNG storage container according to a tenth embodiment of the present invention.

As shown in FIG. 25, an LNG storage container according to a tenth embodiment of the present invention may include a second exhaust line 514*c* connected to the equalizing line 514. A second exhaust valve 514*b* may be installed in the second exhaust line 514*c*. Therefore, gas inside the inner shell 511 may be exhausted to the exterior through the equalizing line 514 and the second exhaust line 514*c* by opening the second exhaust valve 514*b*. As a result, it is possible to avoid a complex process for connecting the exhaust line to the inner shell 511. Also, the structural stability may be maintained, and the exhaust line may be easily installed.

Figure 26:
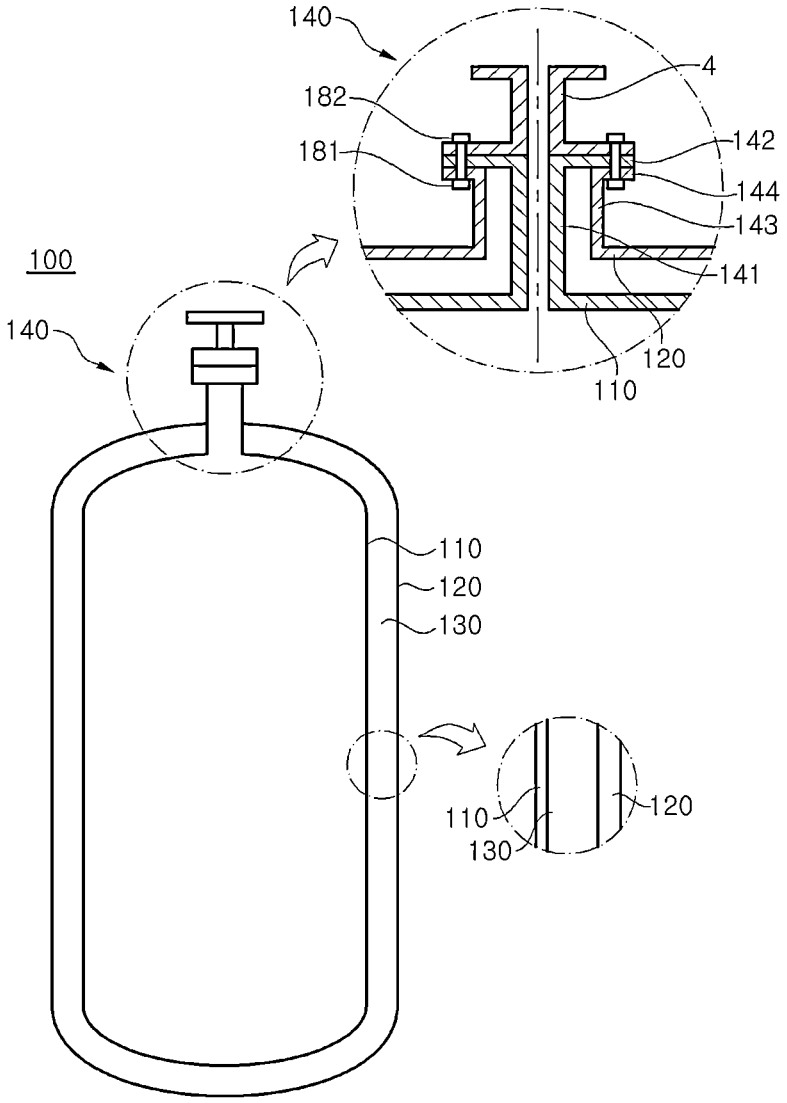
FIG. 26 is a sectional view showing an LNG storage container according to an eleventh embodiment of the present invention.

FIG. 26 is a sectional view showing an LNG storage container according to an eleventh embodiment of the present invention.

As shown in FIG. 26, the LNG storage container 100 according to the eleventh embodiment of the present invention may include an inner shell 110, an outer shell 120, and a heat insulation layer part 130. The inner shell 110 may be made of a metal that withstands a low temperature of the LNG. The outer shell 120 may enclose the outside of the inner shell 110. The heat insulation layer part 130 may be installed between the inner shell 110 and the outer shell 120 in order to reduce a heat transfer. A connecting part 140 may be provided at the inner shell 110 and the outer shell 120. The connecting part 140 may include a first flange 142 and a second flange 144. The first flange 142 is provided for flange connection in such a state that it is in contact with a valve 4 at an end of an injection part 141 extending outward from the inner shell 110. The second flange 144 is provided for flange connection to the valve 4 at an end of an extension part 143 extending from the outer shell 120 to enclose the injection part 141.

The inner shell 110 forms an LNG storage space. The inner shell 110 may be made of a metal that withstands a low temperature of the LNG. For example, the inner shell 110 may be made of a metal having excellent low temperature characteristic, such as aluminum, stainless steel, and 5-9% nickel steel. Like in this embodiment, the inner shell 110 may be formed in a tubular type. Also, the inner shell 110 may have various shapes, including a polyhedron.

The outer shell 120 encloses the outside of the inner shell 110 such that a space is formed between the outer shell 120 and the inner shell 110. The outer shell 120 is made of a steel that withstands the internal pressure of the inner shell 110. The outer shell 120 shares the internal pressure applied to the inner shell 110. Therefore, an amount of a material used for the inner shell 110 may be reduced, leading to a reduction in the production costs of the LNG storage container 100.

Due to a connection passage, the pressure of the inner shell 110 becomes equal or similar to the pressure of the heat insulation layer part 130. Therefore, the outer shell 120 can withstand the pressure of the PLNG. Even though the inner shell 110 is manufactured to withstand a temperature of −120 to −95° C., the PLNG having the above pressure (13 to 25 bar) and temperature condition, for example, a pressure of 17 bar and a temperature of −115° C., can be stored by the inner shell 110 and the outer shell 120. The storage container 100 may be designed to satisfy the above pressure and temperature condition in such a state that the outer shell 120 and the heat insulation layer part 130 are assembled.

Meanwhile, the inner shell 110 may be made to have a thickness smaller than that of the outer shell 120. Therefore, when manufacturing the inner shell 110, the use of expensive metal having excellent low temperature characteristic may be reduced.

The heat insulation layer part 130 is installed in a space between the inner shell 110 and the outer shell 120 and is made of a heat insulator that reduces a heat transfer. In addition, the heat insulation layer part 130 may be constructed or made of a material such that a pressure equal to the internal pressure of the inner shell 110 is applied thereto. The pressure equal to the internal pressure of the inner shell 110 refers to not a strictly equal pressure but a similar pressure.

The heat insulation layer part 130 and the inside of the inner shell 110 may be connected together by a connection passage (not shown) in order for pressure balance between the inside and the outside of the inner shell 110. The connection passage may include various embodiments that can provide a passage, such as a hole or a pipe. For example, the connection passage may include a hole formed in the injection part 141 of the connecting part 140. The internal pressure of the inner shell 110 and the internal pressure of the heat insulation layer part 130 are balanced while the internal pressure of the inner shell 110 moves toward the heat insulation layer part 130 through the connection passage.

When the first flange 142 directly contacts the valve 4, the connecting part 140 is flange-connected by a bolt 181 and a nut 182, such that the injection part 141 is connected to the passage of the valve 4. Since the injection part 141 and the first flange 142 directly contact the LNG, the connecting part 140 may be made of the same material as the inner shell 110. For example, the connecting part 140 may be made of a metal having excellent low temperature characteristic, such as aluminum, stainless steel, or 5-9% nickel steel.

In addition, like in this embodiment, the connecting part 140 may enclose the outside of the injection part 141, while being spaced apart. The second flange 144 may be flange-connected to the valve 4 by the bolt 181 and the nut 182, with the first flange 142 being interposed therebetween. The extension part 143 and the second flange 144 may be made of a steel.

Figure 27:
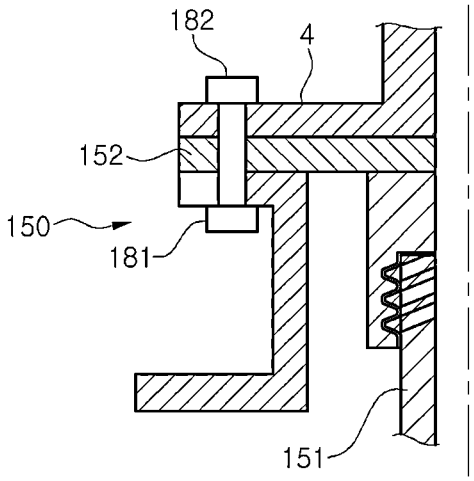
FIG. 27 is a sectional view showing another example of a connecting part of the LNG storage container according to the eleventh embodiment of the present invention.

As shown in FIG. 27, since the first flange 152 is screwed with the injection part 151, the connecting part 150 may form one body with the injection part 151.

Figure 28:
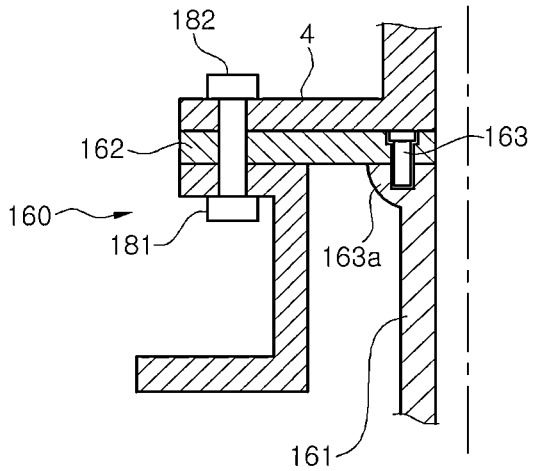
FIG. 28 is a sectional view showing another example of a connecting part of the LNG storage container according to the eleventh embodiment of the present invention.
Figure 28:
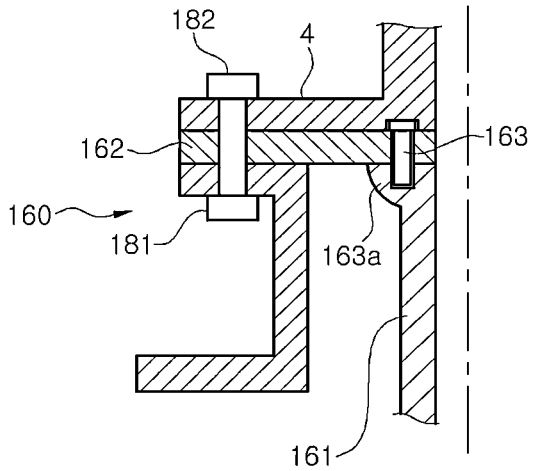

As shown in FIG. 28, the connecting part 160 may fix the first flange 162 to the injection part 161 by a coupling member 163 such as a bolt or a screw. The coupling member 163 may pass through the first flange 162 and be coupled in plurality to a coupling part 163*a*, which is formed at an end of the injection part 161, along a circumferential direction.

In the case that a bolt is used as the coupling member 163, as shown in FIG. 28(*a*), the coupling part 163*a* and the first flange 162 are female threaded, and the first flange 162 and the injection part 161*a* are coupled by a separate male threaded bolt. At this time, in order to avoid interference with adjacent members, a head of the male threaded bolt may be processed such that the bolt head is received in the first flange 162.

If the bolt head is formed to protrude outward from the first flange 162, as shown in FIG. 28, the interference between the bolt head and the adjacent members may be avoided by processing the valve 4 in a bolt head shape capable of receiving the bolt head and then coupling the valve 4 to the first flange 162.

Figure 29:
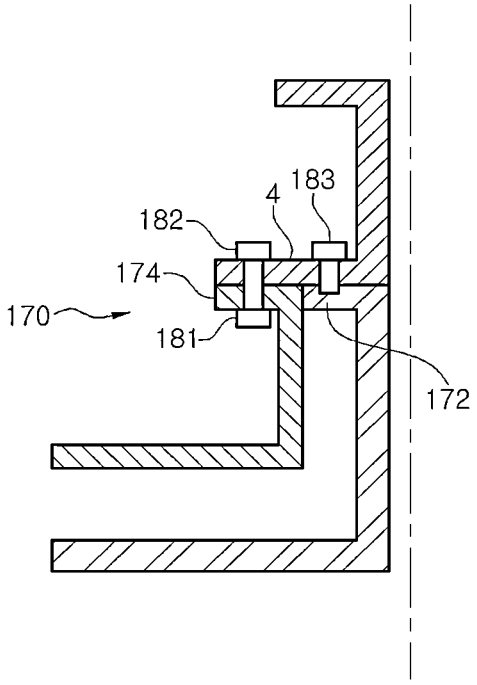
FIG. 29 is a sectional view showing another example of a connecting part of the LNG storage container according to the eleventh embodiment of the present invention.

As shown in FIG. 29, the connecting part 170 may be flange-connected by the bolt 181 and the nut 182 in such a state that the second flange 174 is positioned at an edge of the first flange 172 and connected with the valve 4. In this case, the first flange 172 may be connected to the valve 4 by only the bolt 183.

Figure 30:
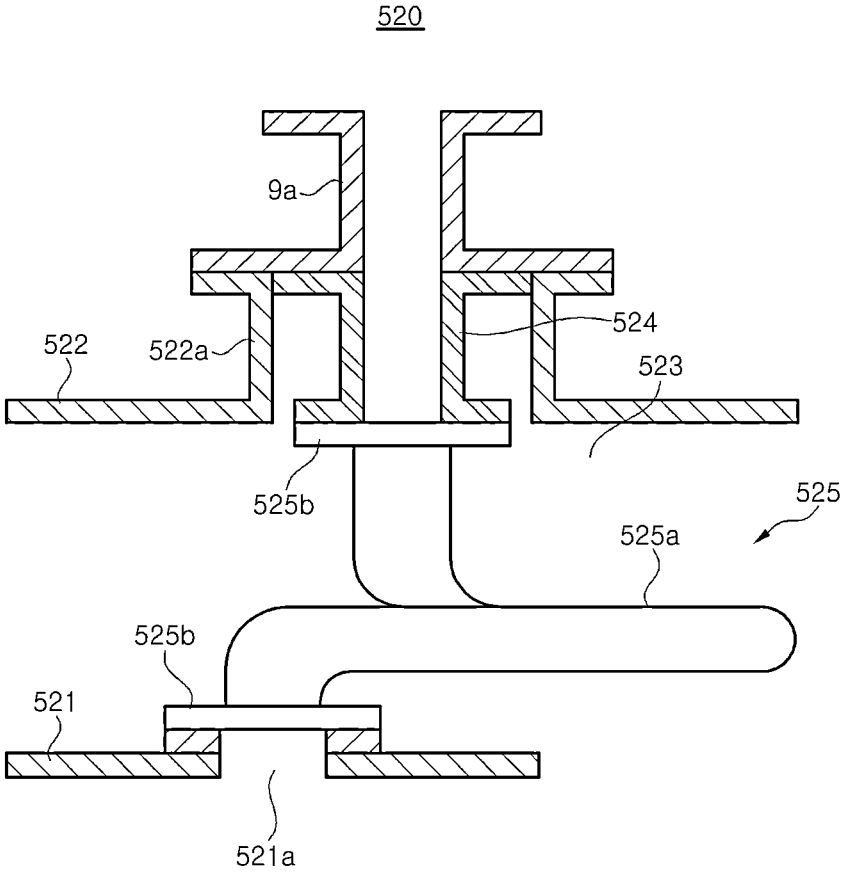
FIG. 30 is an enlarged view showing a main part of an LNG storage container according to a twelfth embodiment of the present invention.

FIG. 30 is an enlarged view showing a main part of an LNG storage container according to a twelfth embodiment of the present invention.

As shown in FIG. 30, the LNG storage container 520 according to the twelfth embodiment of the present invention may include an inner shell 521, an outer shell 522, a connecting part 524, a buffer part 525, and a heat insulation layer part 523. The inner shell 521 stores LNG inside, and the outer shell 522 encloses the outside of the inner shell 521. The connecting part 522 is connected to an external injection part 9*a* and protrudes toward the heat insulation layer part 523. The buffer part 524 buffers a thermal contraction between the connecting part 524 and the inner shell 521. The heat insulation layer part 523 is installed in a space between the inner shell 521 and the outer shell 522.

The inner shell 521 forms an LNG storage space. The inner shell 521 may be made of a metal that withstands a low temperature of the LNG. For example, the inner shell 521 may be made of a metal having excellent low temperature characteristic, such as aluminum, stainless steel, and 5-9% nickel steel. Like in this embodiment, the inner shell 521 may be formed in a tubular type. Also, the inner shell 521 may have various shapes, including a polyhedron.

The outer shell 522 encloses the outside of the inner shell 521 such that a space is formed between the outer shell 522 and the inner shell 521. The outer shell 522 is made of a steel that withstands the internal pressure of the inner shell 521. The outer shell 522 shares the internal pressure applied to the inner shell 521. Therefore, an amount of a material used for the inner shell 521 may be reduced, leading to a reduction in the production costs of the LNG storage container 520.

Due to a connection passage, the pressure of the inner shell 521 becomes equal or similar to the pressure of the heat insulation layer part 523. Therefore, the outer shell 522 can withstand the pressure of the PLNG. Even though the inner shell 521 is manufactured to withstand a temperature of −120 to −95° C., the PLNG having the above pressure (13 to 25 bar) and temperature condition, for example, a pressure of 17 bar and a temperature of −115° C., can be stored by the inner shell 521 and the outer shell 522. The storage container 520 may be designed to satisfy the above pressure and temperature condition in such a state that the outer shell 522 and the heat insulation layer part 523 are assembled.

Meanwhile, the inner shell 521 may be formed to have a thickness smaller than that of the outer shell 522. Hence, when manufacturing the storage container 520, the use of an expensive metal having excellent low temperature characteristic may be reduced.

The heat insulation layer part 523 is installed in a space between the inner shell 521 and the outer shell 522 and is made of a heat insulator that reduces a heat transfer. In addition, the heat insulation layer part 523 may be constructed or made of a material such that a pressure equal to the internal pressure of the inner shell 521 is applied thereto.

The connecting part 524 is provided to protrude from the inner shell 521. The connecting part 524 may be connected to an injection port 521*a*, through which the LNG is injected into the inner shell 521, and protrude outward. The connecting part 524 may be connected to an external injection part 9*a* for injecting the LNG into the inner shell 521. The connecting part 524 may be connected to the inner shell 521 through the buffer part 525. In this case, the outer shell 522 may include an extension part 522*a* that is provided at one side and encloses the connecting part 524. For example, an end of the extension part 522*a* may be connected to the external injection part 9*a* together with the connecting part 524.

The buffer part 525 is provided between the inner shell 521 and the connecting part 524 I in order to buffer a thermal contraction. The buffer part 525 buffers a thermal contraction caused by heat generated from the inner shell 521, preventing load concentration on the connecting part 524.

In addition, like in this embodiment, the buffer part 525 may be provided in a pipe shape that forms joint parts 525*b*, both ends of which are connected to the injection port 521*a* and the connecting part 524 by a flange joint or the like. Furthermore, the buffer unit 525 may be integrally formed between the inner shell 521 and the connecting part 524.

Figure 31:
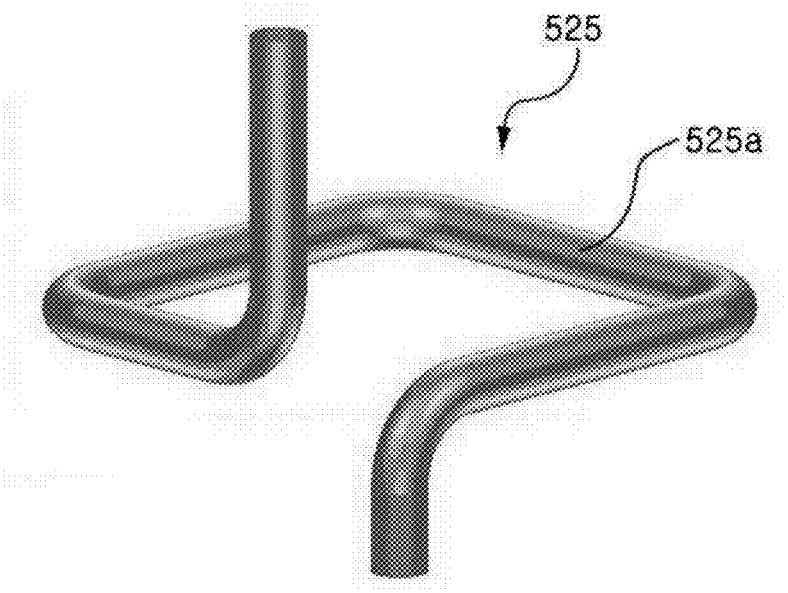
FIG. 31 is a perspective view showing a buffer part provided in the LNG storage container according to the twelfth embodiment of the present invention.

As shown in FIG. 31, the buffer part 525 may have a loop 525*a*. Like in this embodiment, the buffer part 525 may have a single loop 525*a* whose plane shape is polygonal, for example, rectangular.

Figure 32:
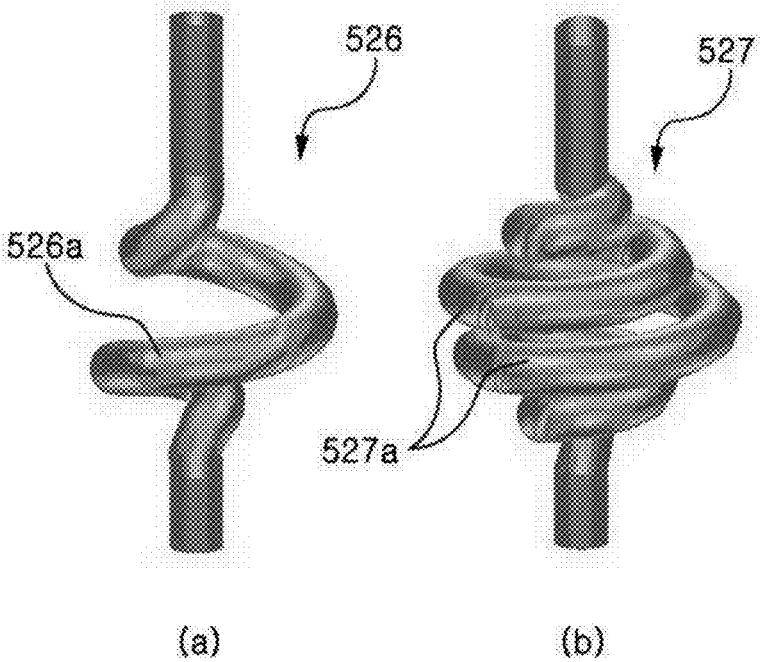
FIG. 32 is a perspective view showing another example of the buffer part provided in the LNG storage container according to the twelfth embodiment of the present invention.

As shown in FIG. 32(*a*), the buffer part 526 may have a single loop 526*a* whose plane shape is circular. As shown in FIG. 32(*b*), the buffer part 527 may have a coil shape with a plurality of loops 527*a*. The coil may have a rhombic shape whose width is gradually reduced from the center toward both ends thereof. Therefore, the loops 526*a* and 527*a* may reduce shocks caused by the thermal contraction of the inner shell 521.

Figure 33:
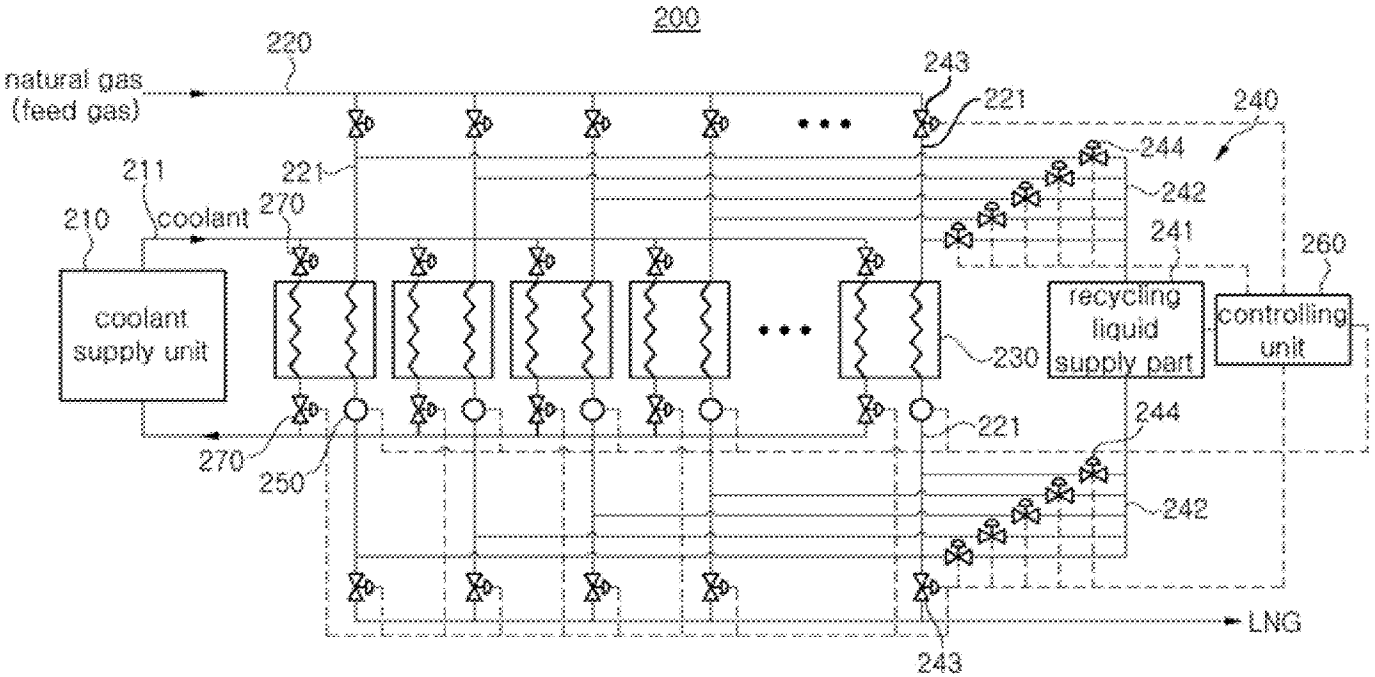
FIG. 33 is a configuration diagram showing an LNG production apparatus according to the present invention.

FIG. 33 is a configuration diagram showing an LNG production apparatus according to the present invention.

In the LNG production apparatus 200 according to the present invention, heat exchangers 230 are installed in a plurality of first branch lines 221 branched from a dehydrated natural gas supply line 220. The heat exchangers 230 cools the dehydrated natural gas supplied through the first branch lines 221 by using a coolant supplied from a coolant supply unit 210. A recycling unit 240 supplies a recycling liquid, instead of natural gas, so as to remove carbon dioxide frozen at the heat exchangers 230.

The LNG production apparatus 200 according to the present invention may be used to produce LNG and PLNG pressurized at a predetermined pressure, for example, PLNG cooled at a pressure of 13 to 25 bar and a temperature of −120 to −95° C.

The coolant supply unit 210 supplies the heat exchangers 230 with a coolant for a heat exchange with the natural gas, so that the natural gas is liquefied at the heat exchangers 230.

The heat exchangers 230 are installed in the plurality of first branch lines 221 branched from the dehydrated natural gas supply line 220 and are connected in parallel. The heat exchangers 230 cools the natural gas supplied from the supply line 220 by a heat exchange with the coolant supplied from the coolant supply unit 210. By making the total capacity exceed the LNG production, one or more of the heat exchangers 230 may be kept in a standby state when producing the LNG.

The number and capacity of the heat exchanger may be determined, considering the LNG production of the entire plants. For example, when the heat exchanger 230 manages 20% of the total LNG production, ten heat exchangers are provided. In this case, five heat exchangers may be driven and the others may be kept in a standby state. This configuration may stop driving the heat exchangers where carbon dioxide is frozen, and may drive the heat exchangers having been in the standby state during the removal of the frozen carbon dioxide. Therefore, the total LNG production of the entire plants may be maintained constantly.

The recycling unit 240 selectively supplies the heat exchangers 230 with the recycling liquid for removing the frozen carbon dioxide, instead of the natural gas. In addition, the recycling unit 240 may include a recycling liquid supply part 241, recycling liquid lines 242, first valves 243, and second valves 244. The recycling liquid supply part 241 supplies the recycling liquid. The recycling lines 242 extend from the recycling liquid supply unit 241 and are connected to front ends and rear ends of the heat exchangers 230 on the first branch lines 221. The first valves 243 are installed at front ends and rear ends of positions connected to the recycling liquid lines 242 on the first branch lines 221. The second valves 244 are installed at front ends and rear ends of the heat exchangers 230 on the recycling liquid lines 242.

The recycling liquid supply part 241 may use high temperature air as the recycling liquid. By supplying the high temperature air to the heat exchangers 230 using a pressure or pumping force, the frozen carbon dioxide may be changed to a liquid or gaseous state and removed.

The LNG production apparatus 200 according to the present invention may further include sensing units 250 and a controlling unit 260. The sensing units 250 are installed to check the freezing of carbon dioxide at the heat exchangers 230 so as to control the supply of the recycling liquid to the heat exchangers 230. The control unit 260 receives sense signals from the sensing units 250 and controls the first and second valves 243 and 244 and the recycling liquid supply part 241.

The controlling unit 260 checks the heat exchangers 230 where the freezing of the carbon dioxide occurs, based on the sense signals output from the sensing units 250. In order to supply the recycling liquid to the heat exchangers 230, the controlling unit 260 closes the first valve 243 to cut off the supply of the natural gas to the heat exchangers 230. Then, the controlling unit 260 drives the recycling liquid supply part 241 and opens the second valve 244 to supply the recycling liquid to the heat exchangers 230. The carbon dioxide frozen at the heat exchangers 230 are liquefied or vaporized by the recycling liquid and then removed. Meanwhile, the controlling unit 260 may supply the recycling liquid to the heat exchangers 230 until a set time is up by a counting operation of a timer.

Like in this embodiment, the sensing units 250 may include flow meters that are installed at rear ends of the heat exchangers 230 on the first branch lines 221 and measure a flow rate of LNG. Therefore, if a flow rate value measured by the sensing unit 250 is equal to or less than a set value, it may be determined that the freezing of carbon dioxide occurs in the corresponding heat exchanger 230.

In addition, the sensing units 250 may further include carbon dioxide meters. The carbon dioxide meters are installed on the first branch lines 221 and measure contents of carbon dioxide contained in gas at the front and rear ends of the heat exchangers 230. If a difference between the contents of carbon dioxide contained in the gas, which are measured at the front and rear ends of the heat exchanger 230, is equal to or larger than a set amount, it may be determined that the freezing of carbon dioxide occurs in the heat exchanger 230.

The LNG production apparatus 200 according to the present invention may further include third valves 270 installed at front and rear ends of the heat exchangers 230 on a coolant line 211 through which the coolant is supplied from the coolant supply unit 210 to the heat exchangers 230 so as to stop the operation of the heat exchangers 230 where the freezing of carbon dioxide occurs. The third valves 270 may be controlled by the controlling unit 260. For example, when it is determined through the sensing unit 260 that the freezing of carbon dioxide occurs in a certain heat exchanger, the controlling unit 260 stops the operation of the corresponding heat exchanger 230 by closing the third valves 270 disposed at the front and rear ends of the corresponding heat exchanger 230.

Figure 34:
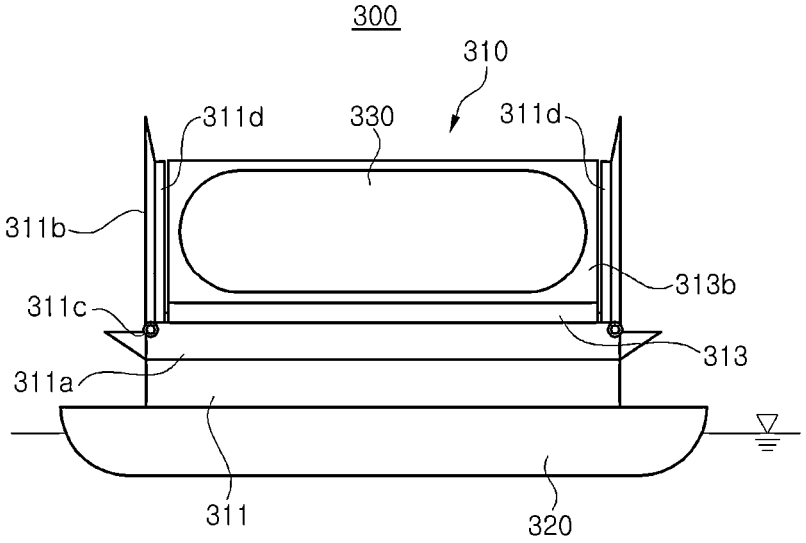
FIG. 34 is a side view showing a floating structure having a storage tank carrying apparatus according to the present invention.
Figure 35:
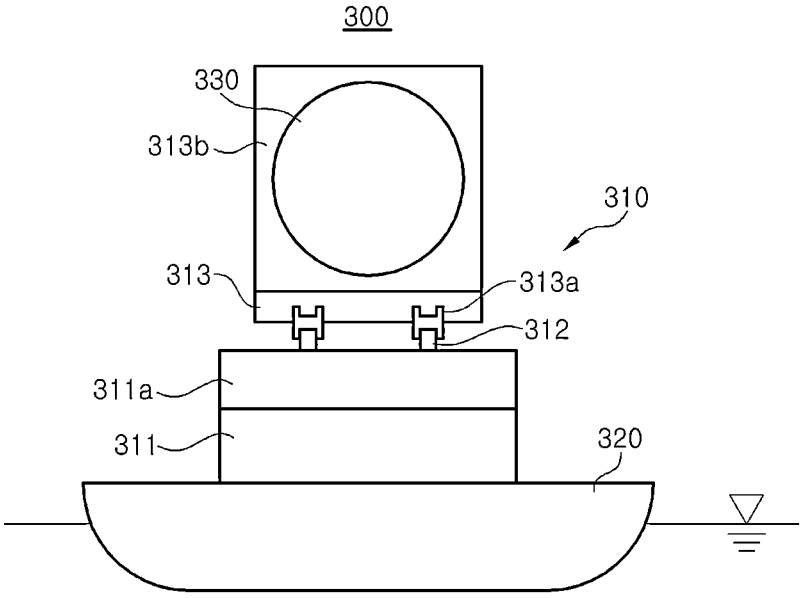
FIG. 35 is a front view showing the floating structure having the storage tank carrying apparatus according to the present invention.

FIGS. 34 and 35 are a side view and a front view, respectively, showing a floating structure having a storage tank carrying apparatus according to the present invention.

As shown in FIGS. 34 and 35, the floating structure 300 according to the present invention includes a storage tank carrying apparatus 310 and a floater 320. The floater is installed to float on the sea by buoyancy. The storage tank carrying apparatus 310 is installed on the floater 320. The floater 320 may be a barge type structure or a self-propelled vessel.

The storage tank carrying apparatus 310 according to the present invention includes a loading table 311*a* and a rail 312. The loading table 331*a* is lifted up and down by an elevating unit 311. The rail 312 is provided on the loading table 331*a* along a moving direction of a storage tank 330. The storage tank 330 is loaded into a cart 313. The cart 313 is installed to be movable along the rail 312.

In this manner, shock applied to the storage tank 330 may be reduced as compared to a case of carrying the storage tank by using a crane. In addition, if a plurality of storage tanks are connected, a large quantity of cargos may be transported over long distance. Therefore, it may be more efficient in terms of costs than other transportation means. Furthermore, it may be more effective to the transportation of a relatively heavy storage tank because it is not a method of lifting and moving the storage tank.

Although it is shown that the storage tank carrying apparatus 310 is installed on the floater 320, the present invention is not limited thereto. The storage tank carrying apparatus 310 may be fixed on the ground or may be installed on various transportation apparatuses.

The storage tank 330 may store LNG or PLNG pressurized at a predetermined pressure. The storage tank 330 may also store various cargos. Meanwhile, the PLNG may be natural gas liquefied at a pressure of 13 to 25 bar and a temperature of −120 to −95° C. In order to store such PLNG, the storage tank 330 may have a structure and be formed of a material that sufficiently withstands a low temperature and a high pressure.

In addition, the storage tank 330 may be manufactured in a dual structure such that it can store LNG or PLNG. As described above, a connection passage may be provided between the dual structure of the storage tank and the inside of the storage tank in order that the internal pressure of the dual structure is balanced with the internal pressure of the storage tank 330.

Figure 36:
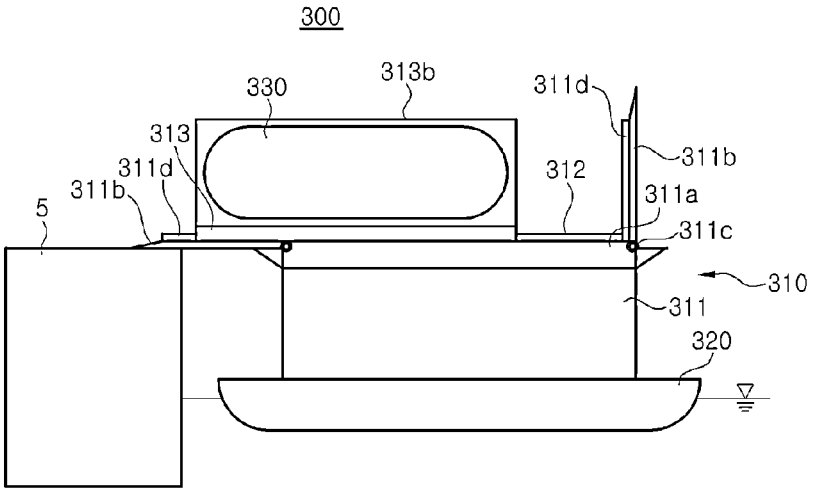
FIG. 36 is a side view explaining the operation of the floating structure having the storage tank carrying apparatus according to the present invention.

As shown in FIG. 36, the elevating unit 311 elevates the loading table 311*a* in a vertical direction. For example, the elevating unit 311 may elevate the loading table 311*a* from the floater 320 up to the top of a quay 5. A movable foothold 311*b* may be installed at one side or both sides of the loading table 311*a*. The movable foothold 311*b* provides a moving path of the cart 313 by being opened through the downward rotation around a hinge coupling part 311*c* disposed under the movable foothold 311*b*.

When the movable foothold 311*b* is folded upward, it restricts the movement of the cart 313. When the loading table 311*a* is elevated to the same height as the quay 5 by the elevating unit 311, the movable foothold 311*b* assists the connection between the quay 5 and the loading table 311*a*. Therefore, the cart 313 may be safely moved to the land. In addition, an auxiliary rail 311*d* connected to the rail 312 may be installed on a plane facing upward when the movable foothold 311*b* is unfolded downward.

In addition, the elevating unit 311 may use various structures and actuators in order for elevating the loading table 311*a*. For example, the loading table 311 may be movable vertically by a plurality of vertically expandable connecting members, which are slidably connected to a lower portion of the loading table 311*a*, or by a plurality of link members, which are linked to a lower portion of the loading table 311*a* and are vertically expandable according to a rotating direction. Also, the loading table 311*a* may be elevated by a motor, which provides a driving force for straight movement, or by an actuator such as a cylinder which is operated by a hydraulic pressure.

The rail 312 is installed on the loading table 311*a* according to a moving direction of the storage tank 330. A pair of rails 312 may be provided. The rails 312 may be arranged in parallel such that they have the same width as rails (not shown) of a train placed on the quay 5. Therefore, the cart 313 elevated up to the top of the quay 5 by the elevating unit 311 is moved along the rail 312 and is transferred to the rail of the quay 5. In this manner, the cart 313 may be moved over long distance by a land transportation means such as a train.

A plurality of wheels 313*a* which are movable along the rail 312 may be provided at the bottom of the cart 313. The storage tank 330 is loaded on the cart 313. In order for connection to other carts, a connecting part may be provided at one side or both sides of the cart 313. In addition, since the storage tank 330 is mounted on the cart 313, a tank protection pad 313*b* made of a steel may be installed on the top surface of the cart 313 in order to protect the storage tank 330 from corrosion and external shock.

For example, the cart 313 may be connected to a winch through a cable and be moved along the rail 312 by the driving of the winch. Also, the cart 313 may be moved along the rail 312 for itself by a transfer driving unit (not shown) that transmits a rotational force to some or all of the wheels 313*a*.

Figure 37:
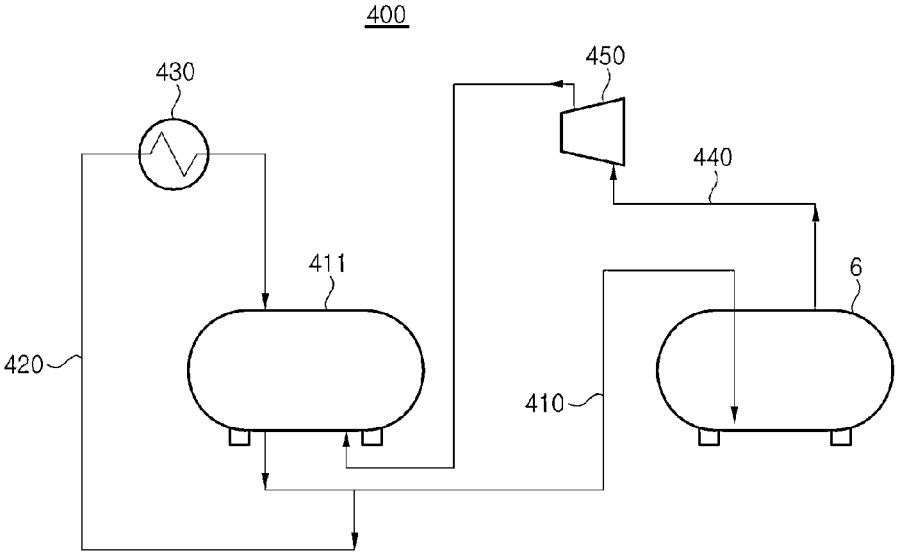
FIG. 37 is a configuration diagram showing a system for maintaining high pressure of a PLNG storage container according to the present invention.

FIG. 37 is a configuration diagram showing a system for maintaining high pressure of a PLNG storage container according to the present invention. As shown in FIG. 37, the system 400 for maintaining high pressure of a PLNG storage container according to the present invention may include an unloading line 410 that connects the storage container 411 to a storage tank 6 of a consumption place to thereby enabling the unloading of PLNG. The system 400 may further include a pressure compensation line 420 and a vaporizer 430 in order to vaporize some of the PLNG unloaded through the unloading line 410 and supply the vaporized PLNG to the storage container 411.

The unloading line 410 enables the unloading of the PLNG by connecting the storage container 411 to the storage tank 6 of the consumption place. Also, the unloading line 410 enables the unloading of the PLNG into the storage tank 6 by only the pressure of the PLNG stored in the storage container 411. By extending the unloading line 410 from the upper portion to the lower portion of the storage tank 6, the PLNG can be unloaded into the storage tank 6 by only the pressure of the PLNG stored in the storage container 411. Furthermore, the generation of BOG can be minimized.

If the unloading line 410 is connected to the lower portion of the storage tank 6 in order to further reduce an amount of BOG generated during the unloading, the PLNG is accumulated from the lower portion of the storage tank 6. In this case, the generation of BOG may be further reduced. However, the pressure may be insufficient to stably unload the PLNG into the storage tank 6 by only the pressure of the PLNG stored in the storage container 411. Therefore, it is necessary to additionally install a pump in the unloading line 410.

The pressure compensation line 420 is branched from the unloading line 410 and is connected to the storage container 411. A vaporizer 430 is installed in the pressure compensation line 420. In addition, the pressure consumption line 420 may be connected to the upper portion of the storage container 411. The reduction in the pressure of the storage container 411 is lowered by minimizing the liquefaction of the natural gas when the natural gas supplied to the storage container 411 through the pressure compensation line 420 contacts the PLNG stored in the storage container 411.

The vaporizer 430 vaporizes the PLNG supplied through the pressure compensation line 420 and supplies the vaporized PLNG to the storage container 411. Therefore, since the natural gas vaporized by the vaporizer 430 is supplied to the storage container 411 through the pressure compensation line 420, the internal pressure of the storage container 411 reduced during the initial unloading of the PLNG is increased. Therefore, the internal pressure of the storage container 411 is maintained at above a bubble point pressure of the LNG.

The system 400 for maintaining high pressure of the PLNG storage container according to the present invention may further include a BOG line 440 and a compressor 450 in order to collect BOG, which is generated in the storage tank of the consumption place, in the form of LNG.

The BOG line 440 is installed such that BOG generated from the storage tank 6 is supplied to the storage container 411. By connecting the BOG line 440 to the lower portion of the storage container 411, a temperature change is minimized and a collection rate of LNG is increased.

In addition, the compressor 450 is installed in the BOG line 440. The compressor 450 compresses the BOG supplied through the BOG line 440, and stores the compressed BOG in the storage container 411. Therefore, The BOG generated in the storage tank 6 during the unloading of the PLNG is supplied to the compressor 450 through the BOG line 440 and is pressurized at the compressor 450. Then, the pressurized BOG is condensed by injecting through the lower portion of the storage container 411. In this manner, the PLNG transportation efficiency can be improved.

Furthermore, in the system 400 for maintaining high pressure of the PLNG storage container according to the present invention, the vaporizer 430 and the compressor 450 can be complementary to each other. Therefore, if an amount of BOG generated in the storage tank 6 is insufficient to maintain the pressure of the storage container 411, the load of the vaporizer 430 is increased. If an amount of BOG is sufficient, the load of the vaporizer 430 is decreased.

Figure 38:
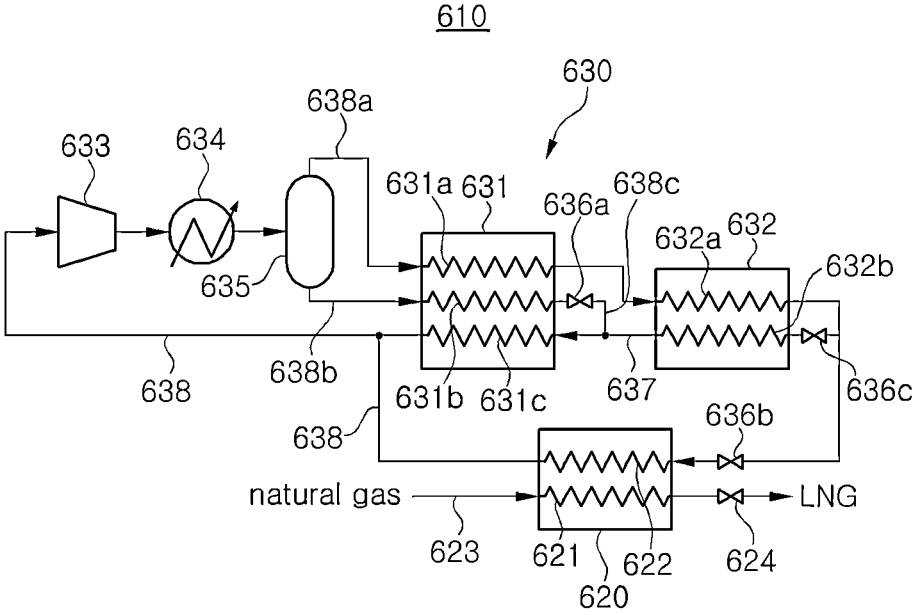
FIG. 38 is a configuration diagram showing a liquefaction apparatus having a separable heat exchanger according to a thirteenth embodiment of the present invention.

FIG. 38 is a configuration diagram showing a liquefaction apparatus having a separable heat exchanger according to a thirteenth embodiment of the present invention.

As shown in FIG. 38, a natural gas liquefaction apparatus 610 having a separable heat exchanger according to a thirteenth embodiment of the present invention liquefies natural gas through a heat exchange with a coolant by a liquefaction heat exchanger 620 made of a stainless steel, and cools a coolant by coolant heat exchangers 631 and 632 and supplies the coolant to the liquefaction heat exchanger 620.

The liquefaction heat exchanger 620 is supplied with the natural gas through the liquefaction line 623 and liquefies the natural gas through a heat exchange with a coolant. To this end, a liquefaction line 623 is connected to a first passage 621, and a coolant circulation line 638 is connected to a second passage 622. The natural gas and the coolant, which respectively pass through the first passage and the second passage, exchange heat with each other. The entire portions of the liquefaction heat exchanger 620 may be made of a stainless steel; however, the present invention is not limited thereto. Some parts or portions of the liquefaction heat exchanger 620, which contact the liquefied natural gas, like the first passage, or need to withstand a cryogenic temperature, may be made of a stainless steel. In the liquefaction line 623, an on/off valve 624 is installed at a rear end of the first passage 621.

Like in this embodiment, the coolant heat exchangers 631 and 632 may include a plurality of coolant heat exchangers, for example, first and second coolant heat exchangers 631 and 632. Also, the coolant heat exchangers 631 and 632 may be provided with a single coolant heat exchanger. The entire portions of the coolant heat exchangers 631 and 632 may be made of aluminum. Also, some parts or portions of the coolant heat exchangers 631 and 632, which need a heat transfer due to the contact with the coolant, may be made of aluminum. In addition, the coolant heat exchangers 631 and 632 may be included in a coolant cooling unit 630.

The coolant cooling unit 630 cools the coolant through the first and second coolant heat exchangers 631 and 632 and supplies the cooled coolant to the liquefaction heat exchanger 620. To this end, for example, the coolant exhausted from the liquefaction heat exchanger 620 is compressed and cooled by a compressor 633 and an after-cooler 634. The coolant having passed through the after-cooler 634 is separated into a gaseous coolant and a liquid coolant by a separator 635. The gaseous coolant is supplied to a first passage 631*a* of the first coolant heat exchanger 631 and a first passage 632*a* of the second coolant heat exchanger 632 by the gaseous line 638*a*. The liquid coolant is passed through a second passage 631*b* of the first coolant heat exchanger 631 by the liquid line 638*b* and is expanded to a low pressure by a first Joule-Thomson (J-T) valve 636*a* along a connection line 638*c*. Then, the liquid coolant is supplied to the compressor 633 through a third passage 631*c* of the first coolant heat exchanger 631, and is compressed by the compressor 633. Then, the subsequent processes are repeated.

In addition, the cooling unit 630 expands the high pressure coolant, which has passed through the first passage 632*a* of the second coolant heat exchanger 632, to a low pressure by a second J-T valve 636*b*, and supplies the coolant to the liquefaction heat exchanger 620. Also, the cooling unit 630 expands the coolant to a low pressure by a third J-T valve 636*c* through a coolant supply line 637, and supplies the compressor 633 with the coolant through the second passage 632*b* of the second coolant heat exchanger 632 and the third passage 631*c* of the first coolant heat exchanger 631.

The after-cooler 634 removes a compression heat of the coolant compressed by the compressor 633, and liquefies a part of the coolant. In addition, the first coolant heat exchanger 631 cools the unexpanded high-temperature coolant, which is supplied through the first and second passages 631*a* and 631*b*, by a heat exchange with the expanded low-temperature coolant, which is supplied through the third passage 631*c*. The second coolant heat exchanger 632 cools the unexpanded high-temperature coolant, which is supplied through the first passage 632*a*, by a heat exchange with the expanded low-temperature coolant, which is supplied through the second passage 632*b*.

Furthermore, the liquefaction heat exchanger 620 is supplied with the low-temperature coolant expanded through the first and second heat exchangers 631 and 632 and the second J-T valve 636*b*, and cools and liquefies the natural gas.

Figure 39:
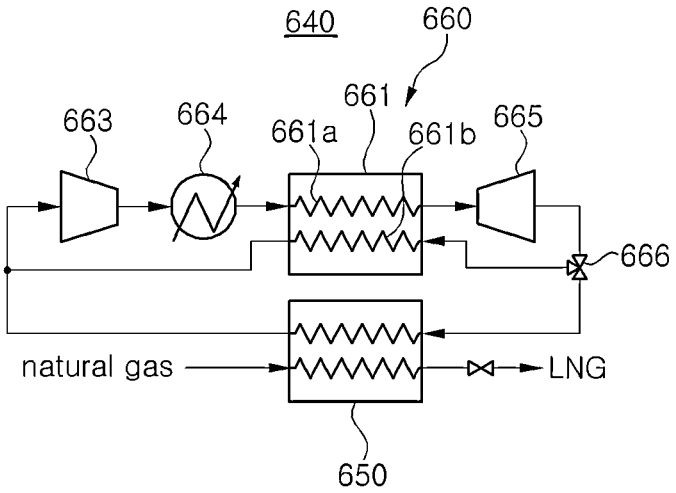
FIG. 39 is a configuration diagram showing a liquefaction apparatus having a separable heat exchanger according to a second embodiment of the present invention.

FIG. 39 is a configuration diagram showing a liquefaction apparatus having a separable heat exchanger according to a fourteenth embodiment of the present invention.

As shown in FIG. 39, like the natural gas liquefaction apparatus 610 according to the thirteenth embodiment of the present invention, a natural gas liquefaction apparatus 640 having a separable heat exchanger according to a fourteenth embodiment of the present invention includes a liquefaction heat exchanger 650 and a coolant cooling unit 660. The liquefaction heat exchanger 650 is supplied with natural gas and liquefies the natural gas through a heat exchange with a coolant. The liquefaction heat exchanger 650 is made of a stainless steel. The coolant cooling unit 660 cools the coolant by a coolant heat exchanger 661 and supplies the cooled coolant to the liquefaction heat exchanger 650. The coolant heat exchanger 661 is made of aluminum. Descriptions of the same configuration and parts as the natural gas liquefaction apparatus 610 according to the thirteenth embodiment of the present invention will be omitted, and a difference between the two liquefaction facilities will be described below.

The coolant cooling unit 660 compresses and cools the coolant, which is exhausted from the liquefaction heat exchanger 650, by a compressor 663 and an after-cooler 664, and supplies the coolant to a first passage 661*a* of the coolant heat exchanger 661. The coolant cooling unit 660 expands the coolant, which has passed through the first passage 661*a* of the coolant heat exchanger 661, by an expander 665, and supplies the coolant to the liquefaction heat exchanger 650 or supplies the coolant to the compressor 663 through the second passage 661*b* of the coolant heat exchanger 661, according to the manipulation of a flow distribution valve 666. Like in this embodiment, the flow distribution valve 666 may be a three-way valve. Also, the flow distribution valve 666 may be a plurality of two-way valves.

The coolant heat exchanger 661 cools the unexpanded high-temperature coolant, which is supplied through the first passage 661*a*, by a heat exchange with the expanded low-temperature coolant, which is supplied through the second passage 661*a*. In addition, the low-temperature coolant is distributed to the coolant heat exchanger 661 and the liquefaction heat exchanger 650 according to the manipulation of the flow distribution valve 666. The liquefaction heat exchanger 650 cools and liquefies the natural gas by the low-temperature coolant having passed through the coolant heat exchanger 661 and the expander 665.

Figure 40:
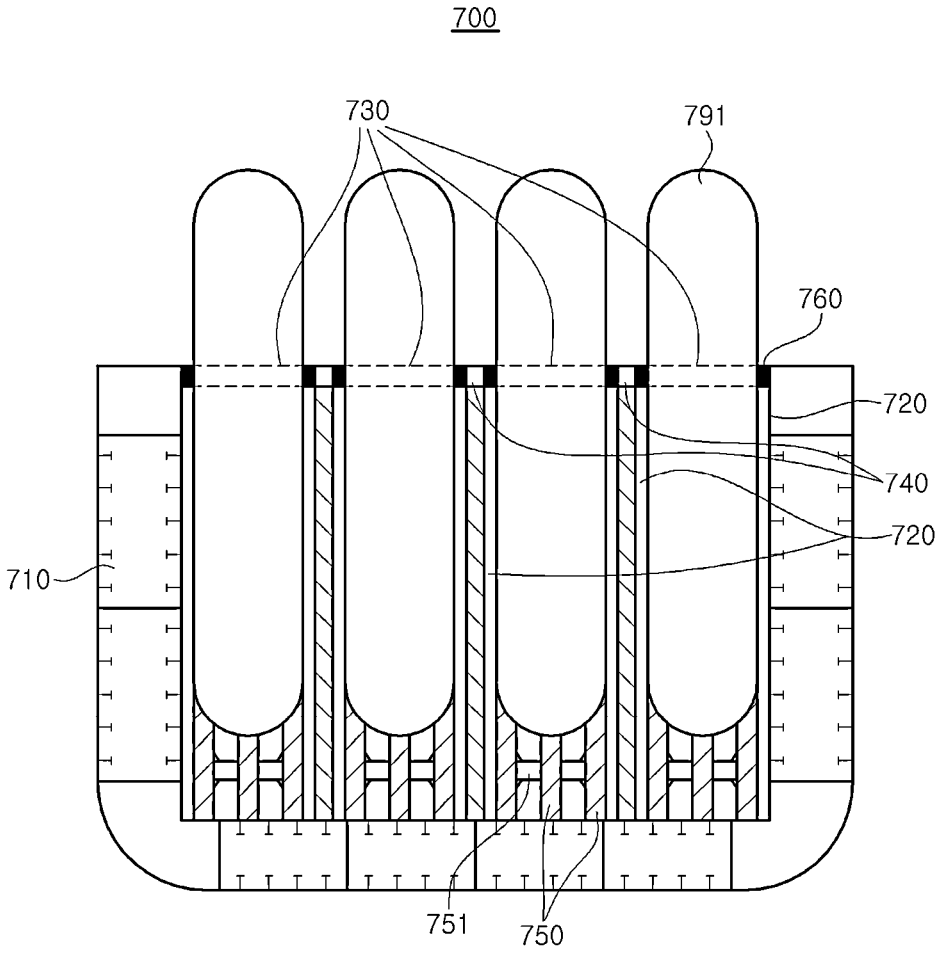
FIG. 40 is a front sectional view showing an LNG storage container carrier according to the present invention.
Figure 41:
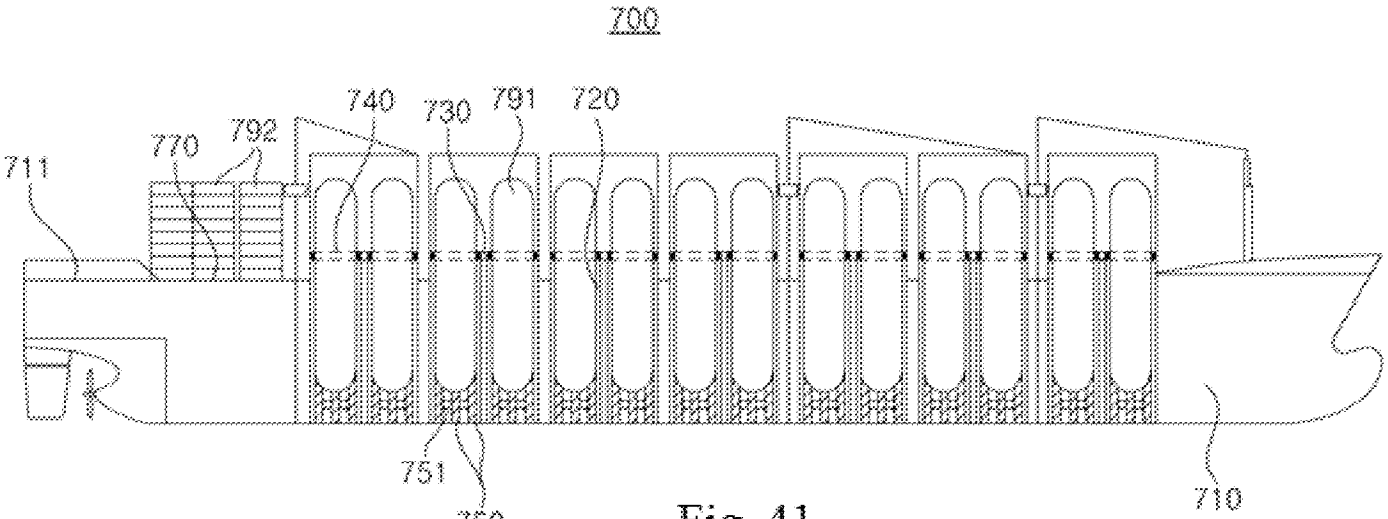
FIG. 41 is a side sectional view showing the LNG storage container carrier according to the present invention.

FIGS. 40 and 41 are a front sectional view and a side sectional view, respectively, showing an LNG storage tank carrier according to the present invention.

As shown in FIGS. 40 and 41, the LNG storage container carrier 700 according to the present invention is a vessel for transporting a storage container storing LNG. The LNG storage container carrier 700 includes a plurality of first and second upper supports 730 and 740. The first and second upper supports 730 and 740 are installed in a width direction and a length direction on cargo holds 720 provided in a hull 710, and partition the upper portions of the cargo holds 720 into a plurality of openings 721. Storage containers 791 inserted into the respective openings 721 are supported by the first and second supports 730 and 740.

Meanwhile, the storage containers 791 may store general LNG and LNG pressurized at a predetermined pressure, for example, PLNG having a pressure of 13 to 25 bar and a temperature of −120 to −95° C. To this end, a dual structure or a heat insulation member may be installed. The storage containers 791 may have various shapes, for example, a tubular shape or a cylindrical shape.

The cargo hold 720 may be provided in the hull 710 such that the upper portions thereof are opened. In this case, a hull of a container vessel may be used as the hull 710. Therefore, time and costs necessary for building the LNG storage container carrier 700 may be reduced.

Figure 42:
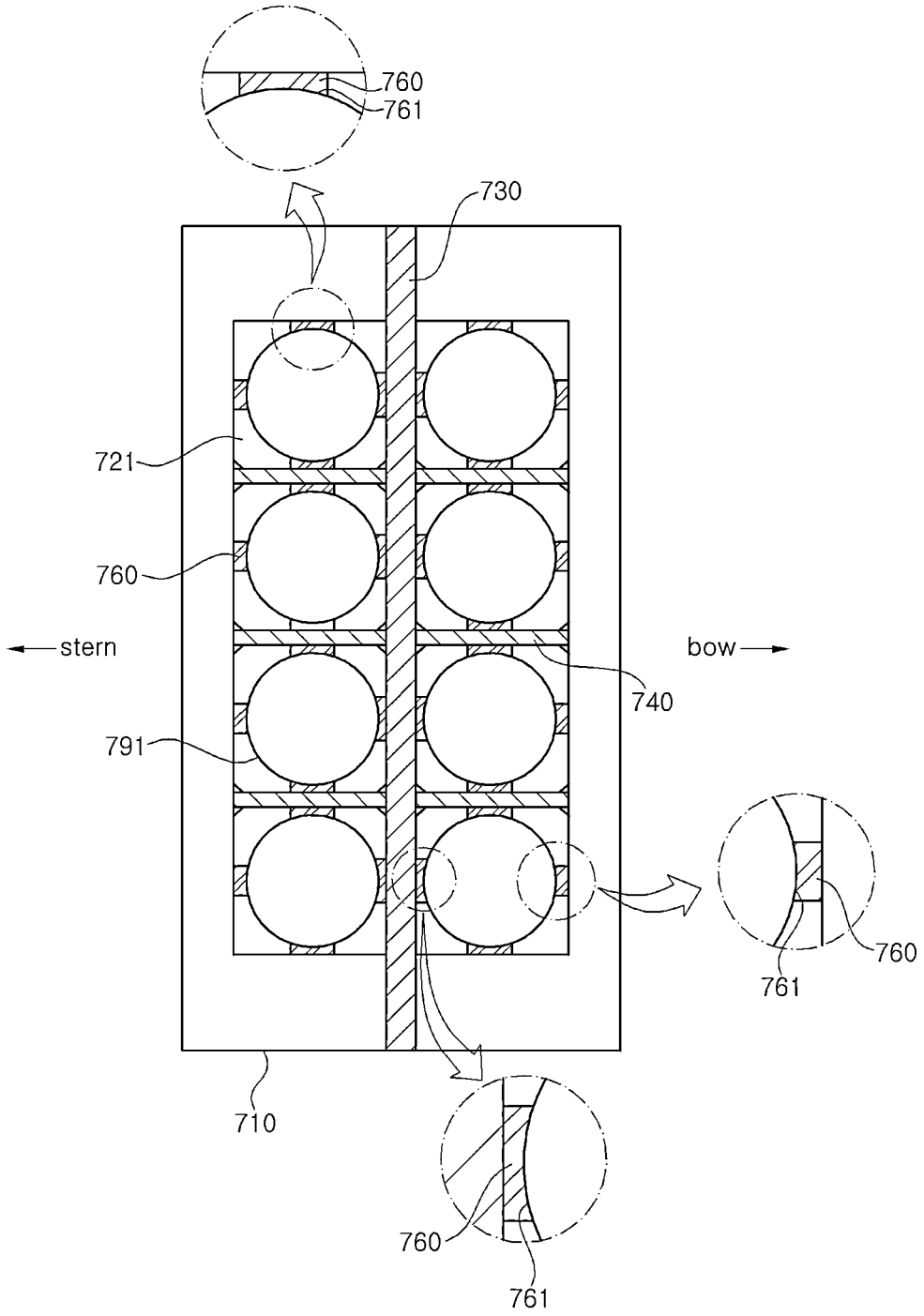
FIG. 42 is a plan view showing a main part of the LNG storage container carrier according to the present invention.

As shown in FIG. 42, the plurality of first and second upper supports 730 and 740 are installed on the cargo holds 720 in a width direction and a length direction, and partition the upper portions of the cargo holds 720 into the plurality of openings 721. The storage containers 791 are vertically inserted into the respective openings 721 and are supported. That is, the first upper supports 730 are installed on the cargo holds 720 in the width direction of the hull 710, while being spaced apart along the length direction of the hull 710. In addition, the second upper supports 740 are installed on the cargo holds 720 in the length direction of the hull 710, while being spaced apart along the width direction of the hull 710. Therefore, the first and second upper supports 730 and 740 form the plurality of openings 721 on the upper portions of the cargo holds 720 in a horizontal direction and a vertical direction. The first and second upper supports 730 and 740 may be fixed to the upper portions of the cargo holds 720 by welding or a coupling member such as a bolt.

In addition, a plurality of support blocks 760 for supporting the sides of the storage containers 791 may be installed in some or entire portions of the inner surfaces of the cargo holds 720 and the first and second upper supports 730 and 740. The support blocks 760 may be provided to support the front and rear and the left and right of the storage containers 791. The support blocks 760 may have support planes 761 with a curvature corresponding to a curvature of the outer surfaces of the storage containers 791, so as to stably support the storage containers 791.

A plurality of lower supports 750 may be installed under the cargo holds 720. The lower supports 750 support the bottoms of the storage containers 791 inserted into the openings 721. The lower supports 750 are vertically installed upwardly on the bottoms of the cargo holds 720. Reinforcement members 751 may be further installed to maintain the gaps between the lower supports 750. Meanwhile, the lower supports 750 and the reinforcement members 751 are paired at each storage container 791. A plurality of pairs of the lower supports 750 and the reinforcement members 751 may be installed on the bottoms of the cargo holds 720 and support the lower portions of the storage containers 791.

In the case of a container vessel, the LNG storage container carrier 700 according to the present invention may use a stanchion or a lashing bridge, without modifications, in order to support the storage containers 791. In this case, the first and second upper supports 730 and 740 may be fixed and supported to the stanchion and the lashing bridge.

Therefore, if the conventional container vessel is modified slightly, it may be converted to enable the transportation of the storage containers 791. A container loading part 770 may be additionally provided on a deck 711 so as to transport container boxes 792 together with the storage containers 791.

Figure 43:
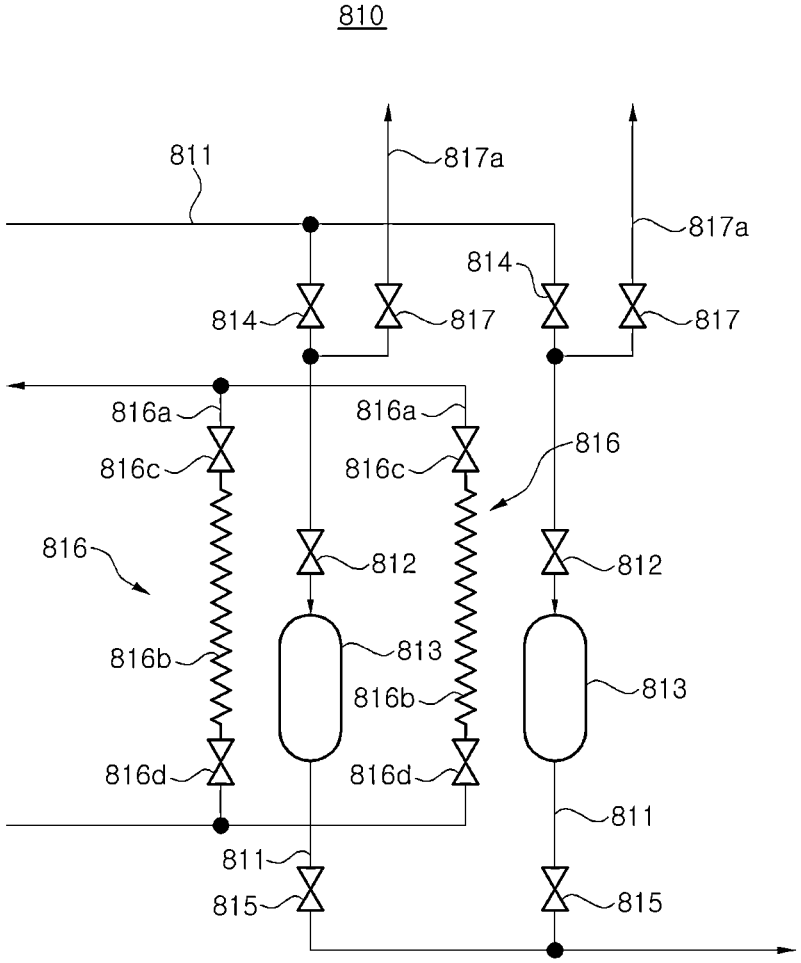
FIG. 43 is a configuration diagram showing a solidified carbon-dioxide removal system according to the present invention.

FIG. 43 is a configuration diagram showing a solidified carbon-dioxide removal system according to the present invention.

As shown in FIG. 43, the solidified carbon-dioxide removal system according to the present invention may include an expansion valve 812, a solidified carbon-dioxide filter 813, and a heating unit 816. The expansion valve 812 depressurizes high-pressure natural gas to a low pressure. The solidified carbon-dioxide filter 813 is installed at a rear end of the expansion valve 812 and filters frozen solidified carbon dioxide existing in the LNG. The heating unit 816 vaporizes the solidified carbon dioxide of the expansion valve 812 and the solidified carbon-dioxide filter 813. The solidified carbon dioxide is filtered from the liquefied natural gas by the solidified carbon-dioxide filter 813. Heat is supplied from the heating unit 816 in such a state that the supply of the natural gas to the expansion valve 812 and the solidified carbon-dioxide filter 813 is interrupted. Therefore, the solidified carbon dioxide may be recycled and removed.

The expansion valve 812 is installed in a supply line 811 through which the high-pressure natural gas is supplied. The expansion valve 812 liquefies the high-pressure natural gas by depressurizing the high-pressure natural gas supplied through the supply line 811.

The solidified carbon-dioxide filter 813 is installed at a rear end of the expansion valve 812 in the supply line 811. The solidified carbon-dioxide filter 813 filters the frozen solidified carbon dioxide from the LNG supplied from the expansion valve 812. To this end, a filter member for filtering carbon dioxide solid may be installed inside the solidified carbon-dioxide filter 813.

Furthermore, in the expansion valve 812 and the solidified carbon-dioxide filter 813, the supply of the high-pressure natural gas and the exhaust of the low-pressure LNG are opened and closed by first and second on/off valves 814 and 815. To this end, the first and second on/off valves 814 and 815 are installed at a front end of the expansion valve 812 and a rear end of the solidified carbon-dioxide filter 813 in the supply line 811, and open and close the natural gas flow. The first on/off valve 814 opens and closes the supply of the high-pressure natural gas to the expansion valve 812, and the second on/off valve 815 opens and closes the exhaust of the lower-pressure LNG discharged from the solidified carbon-dioxide filter 813

The heating unit 816 supplies heat to vaporize the solidified carbon dioxide of the expansion valve 812 and the solidified carbon-dioxide filter 813. For example, the heating unit 816 may include a recycling heat exchanger 816*b* and fourth and fifth on/off valves 816*c* and 816*d*. The recycling heat exchanger 816*b* is installed in a heat medium line 816*a* through which a heat medium is circulated by a heat exchange with the expansion valve 812 and the solidified carbon-dioxide filter 813. The fourth and fifth on/off valves 816*c* and 816*d* are installed at a front end and a rear end of the recycling heat exchanger 816*b* in the heat medium line 816*a*.

A third on/off valve 817 is installed in an exhaust line 817*a* through which carbon dioxide recycled by the heating unit 816 is exhausted to the exterior.

The third on/off valve 817 is installed to open and close the exhaust of the carbon dioxide recycled by the heating unit 816 to the exhaust line 817*a*, which is branched from the supply line 811 between the first on/off valve 814 and the expansion valve 812.

In addition, the solidified carbon-dioxide removal system 810 according to the present invention may be provided in plurality. While some of the carbon-dioxide removal facilities 810 perform the filtering of the carbon dioxide, others may perform the recycling of the carbon dioxide, under the control of the first to third on/off valves 814, 815 and 817 and the heating unit 816. In this embodiment, two carbon-dioxide removal facilities 810 are provided. In this case, the two carbon-dioxide removal facilities 810 may alternately perform the filtering and recycling of the carbon dioxide. This operation will be described below with reference to the accompanying drawings.

Figure 44:
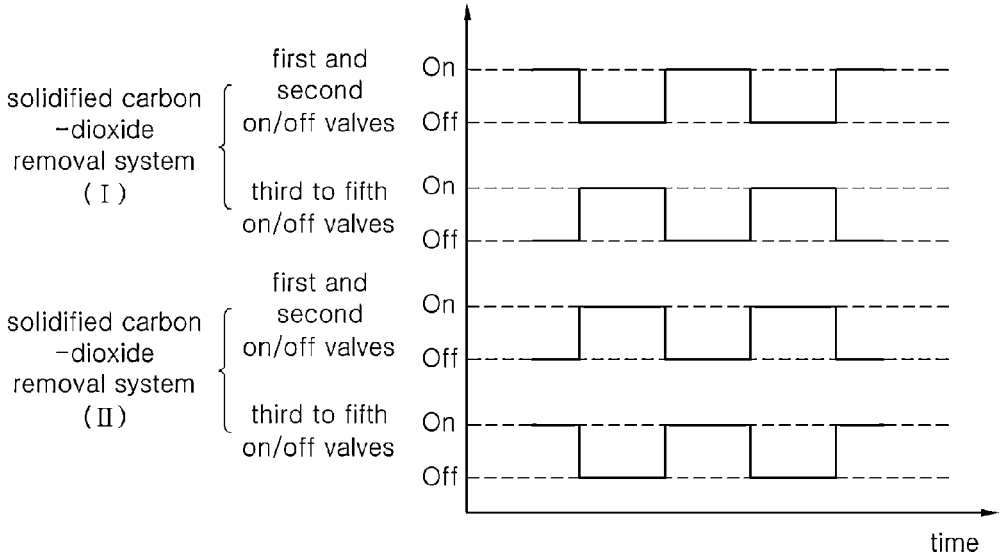
FIG. 44 is a configuration diagram showing the operation of a solidified carbon-dioxide removal system according to the present invention.

As shown in FIG. 44, the following description will be focused on one of the solidified carbon-dioxide removal systems 810 according to the present invention. First, if the first and second on/off valves 814 and 815 are opened to supply high-pressure natural gas to the expansion valve 812 through the supply line 811 and expand the natural gas to a low pressure, the natural gas is cooled and the low-pressure LNG is supplied to the solidified carbon-dioxide filter 813. The solidified carbon dioxide included in the LNG by the cooling is filtered by the carbon-dioxide filter 813. If the solidified carbon dioxide is continuously accumulated in the solidified carbon-dioxide filter 813, the first and second on/off valves 814 and 815 are closed to stop supplying the high-pressure natural gas through the supply line 811. Then, the fourth and fifth on/off valves 816*c* and 816*d* are opened to circulate the heat medium to the recycling heat exchanger 816*b*. Therefore, heat is supplied to the expansion valve 812 and the solidified carbon-dioxide filter 813, and the solidified carbon dioxide is vaporized and recycled.

The third on/off valve 817 is opened to exhaust the recycled carbon dioxide to the exterior through the exhaust line 817*a*. Thus, the recycled carbon dioxide is removed.

In addition, in the case that the solidified carbon-dioxide removal system 810 according to the present invention is provided in plurality, for example, two carbon-dioxide removal facilities 810 are provided, one carbon-dioxide removal facility I performs the filtering of the solidified carbon dioxide from the natural gas, and the other II performs an opposite operation, under the control of the first to fifth on/off valves 814, 815, 817, 816*c* and 816*d*. In this manner, the solidified carbon dioxide is vaporized and recycled.

The solidified carbon-dioxide removal system 810 according to the present invention employs a low temperature method, among carbon dioxide removal methods, which solidifies carbon dioxide by freezing it and separates the carbon dioxide. Hence, it is possible to combine with a natural gas liquefaction process. In this case, a process of removing a pre-processed carbon oxide is not needed, leading to a reduction of facilities. In addition, in the case that carbon oxide is solidified when the natural gas rapidly supplied at high pressure is liquefied and it is expanded and depressurized to a low pressure by the expansion valve 812, the solidified carbon dioxide is filtered by a mechanical filter, that is, the solidified carbon-dioxide filter 813. In the case that the solidified carbon dioxide is continuously accumulated in the solidified carbon-dioxide filter 813, the solidified carbon-dioxide filters 813 are alternately used to recycle the carbon dioxide.

Figure 45:
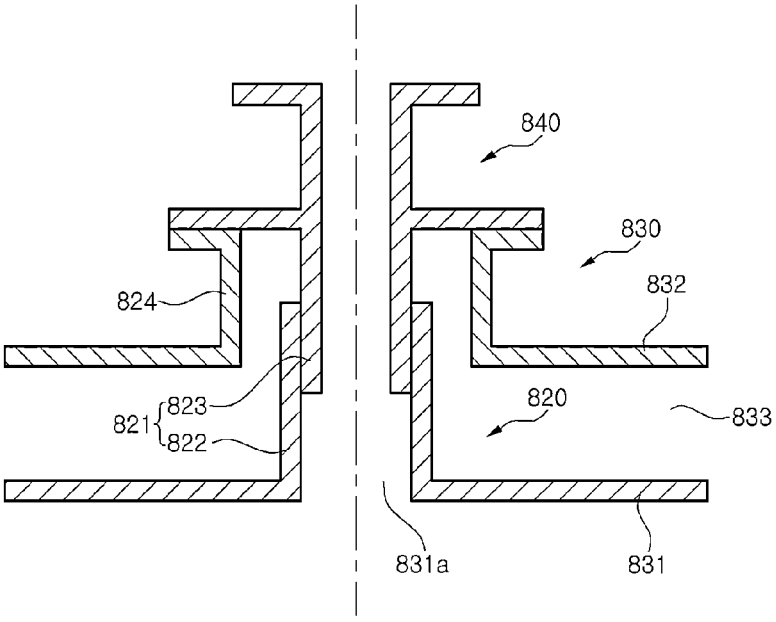
FIG. 45 is a sectional view showing the connection structure of the LNG storage container according to the present invention.

FIG. 45 is a sectional view showing the connection structure of the LNG storage container according to the present invention.

As shown in FIG. 45, the connection structure 820 of the LNG storage container according to the present invention is configured to connect the inner shell 831 of the LNG storage container 830 having a dual structure and the external injection 840. The inner shell 831 and the external injection part 840 are slidingly connected. To this end, a sliding connecting part 821 may be included in the connection structure 820.

The sliding connecting part 821 is provided at a connecting portion of the external injection part 840 and the inner shell 831. In order to buffer a thermal contraction or thermal expansion of the inner shell 831 or the outer shell 832, the sliding connecting part 821 may be provided such that the connecting portion of the external injection part 840 and the inner shell 831 are slidable along a direction in which a displacement occurs due to the thermal contraction or the thermal expansion.

Meanwhile, in the storage container 830, the inner shell 831 stores LNG inside, and the outer shell 832 encloses the outside of the inner shell 831. A heat insulation layer part 833 for reducing temperature influence may be installed in a space between the inner shell 831 and the outer shell 832.

The inner shell 831 may be made of a metal that withstands a low temperature of general LNG. For example, the inner shell 831 may be made of a metal having excellent low temperature characteristic, such as aluminum, stainless steel, and 5-9% nickel steel.

Like the previous embodiments, the outer shell 832 of the storage container 830 may be made of a steel that withstands the internal pressure of the inner shell 831. The outer shell 832 may be constructed such that the same pressure is applied to the inside of the inner shell 831 and the space where the heat insulation layer part 833 is installed. For example, the internal pressure of the inner shell 831 and the pressure of the heat insulation layer part 833 may be equal or similar to each other by a connection passage connecting the inner shell 831 and the heat insulation layer part 833.

Therefore, the outer shell 832 can withstand the pressure of the PLNG stored in the inner shell 831. Even though the inner shell 831 is manufactured to withstand a temperature of −120 to −95° C., the PLNG having the above pressure (13 to 25 bar) and temperature condition, for example, a pressure of 17 bar and a temperature of −115° C., can be stored by the inner shell 831 and the outer shell 832.

In addition, the storage container 830 may be designed to satisfy the above pressure and temperature condition in such a state that the outer shell 832 and the heat insulation layer part 833 are assembled.

In the sliding connecting part 821, the connecting part 822 extending outward from the injection port 831*a* formed for the injection and exhaust of LNG may be fitted and slidingly connected to the connecting part 823 protruding from the external injection part 840.

Figure 46:
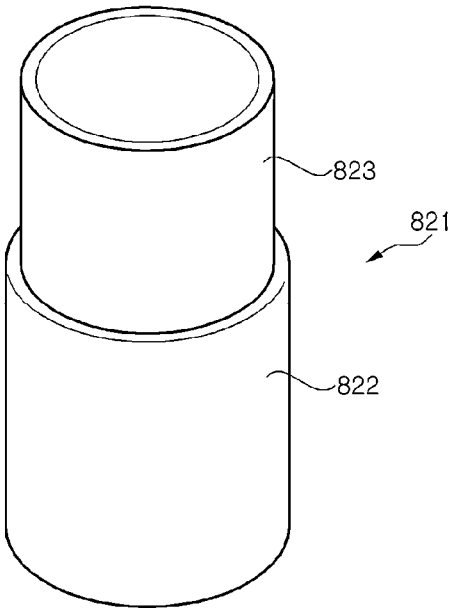
FIG. 46 is a perspective view showing the connection structure of the LNG storage container according to the present invention.

As shown in FIG. 46, the connecting part 822 and the connecting part 823 are formed in a circular pipe. One of the two connecting parts 822 and 823 is inserted into and slidingly connected to the other; however, the present invention is not limited thereto. The connecting parts 822 and 823 may be slidingly connected by forming their cross-sectional shapes corresponding to each other. The connecting parts 822 and 823 may have various cross-sectional shapes, for example, a rectangular shape.

The connection structure 820 of the LNG storage container according to the present invention may further include an extension part 824 extending from the outer shell 832 to enclose the sliding connecting part 821. Therefore, the extension part 824 may prevent the influence of the external environment, which has been caused by the external exposure of the sliding connecting part 821. In addition, since a flange is formed at an end of the extension part 824, the extension part 824 may be flange-connected to the external injection part 840. Therefore, the storage container 830 may be stably connected to the external injection part 840.

Meanwhile, like in this embodiment, the connecting part 823 provided in the external injection part 840 may be integrally formed with the external injection part 840. Unlike this case, the connecting part 823 may be provided separately from the external injection part 840 and be fixed to the extension part 824. At this time, the connecting part 823 may be flange-connected to the external injection part 840 or may be connected in various manners.

Figure 47:
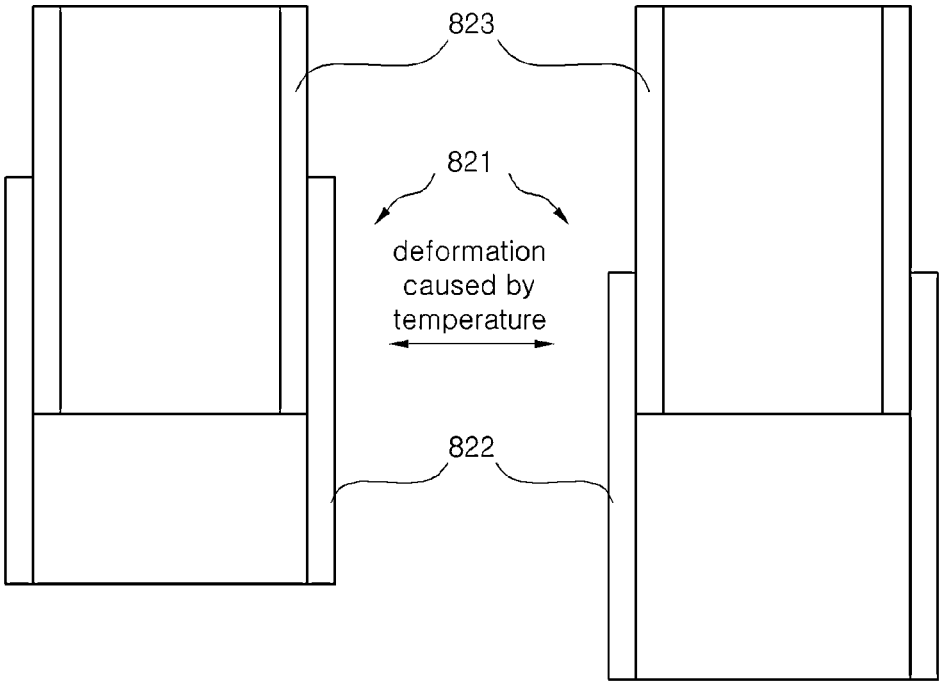
FIG. 47 is a sectional view explaining the operation of the connection structure of the LNG storage container according to the present invention.

As shown in FIG. 47, in the connection structure 820 of the LNG storage container according to the present invention, the connecting part 822 and the connecting part 823 are slidably moved, even though the load is concentrated on the connecting portion between the inner shell 831 and the external injection part 840 by the thermal contraction or the thermal expansion. Therefore, the thermal contraction or the thermal expansion is reduced, thereby preventing the load concentration on the inner shell 831 and the external injection part 840. As a result, damage caused by the thermal contraction or the thermal expansion may be prevented.

Furthermore, the natural gas inside the storage container 830 may be moved to the heat insulation layer part 833 through the gap (tolerance) of the sliding connecting part 821. Therefore, the pressure of the heat insulation layer part 833 may become equal or similar to the pressure of the inner shell 831. As shown in FIGS. 23 to 25, this can obtain an effect of substituting for the equalizing line for maintaining the equivalent pressure of the heat insulation layer part 833 and the inner shell 831.

According to the present invention, it is possible to efficiently and stably transport the storage containers storing LNG or PLNG pressurized at a predetermined pressure. Also, such storage containers may be transported through simple modification of the existing container carrier. In particular, structures such as stanchion and lashing bridge for supporting the upper container boxes may be utilized in the container carrier, thereby minimizing time and cost for manufacturing the storage container carrier. Since a spare space is provided under the storage container, various pipes and equipments may be easily installed. It is possible to prevent the loaded storage containers from obstructing the sight necessary for navigation of the carrier.

While the embodiments of the present invention has been described with reference to the specific embodiments, it will be apparent to those skilled in the art that various changes and modifications may be made without departing from the spirit and scope of the invention as defined in the following claims.

What is claimed is:

1. A liquefied natural gas (LNG) storage container carrier comprising:

one or more cargo holds provided on a hull such that upper portions thereof are opened;

a plurality of first and second upper supports installed on the cargo holds in a width direction and a length direction to partition the upper portions of the cargo holds into a plurality of openings, wherein storage containers are vertically inserted into the openings such that upper portions of the storage containers over the openings are exposed to an external environment when the storage containers are carried using the LNG storage container carrier; and a lower support installed under the cargo holds and supporting bottoms of the storage containers inserted into the openings, wherein the LNG is an LNG that has been pressurized and liquefied at a pressure of 13 to 25 bar and a temperature of −120 to −95° C., wherein each of the storage containers includes an inner shell storing the LNG, an outer shell enclosing the inner shell, a heat insulation layer disposed between the inner shell and the outer shell, and a connection passage, between the inner shell and the heat insulation layer, providing a fluid path to make a pressure on an inside surface of the inner shell substantially equal to a pressure on an outside surface of the inner shell, and wherein each of the storage containers further includes an external injection part coupled to an end part of the outer shell, a connecting part coupled to the external injection part, and a buffer part coupled between the connecting part and an end part of the inner shell and having a tube-shaped structure.

2. The LNG storage container carrier according to claim 1, further comprising a plurality of support blocks disposed on some or entire portions of inner surfaces of the cargo holds and the first and second upper supports to support corresponding outer surfaces of the storage containers.

3. The LNG storage container carrier according to claim 2, wherein the support blocks each are provided to support front, rear, left, and right portions of a corresponding one of the storage containers, and the support blocks have support planes with curvatures corresponding to a curvature of the outer surfaces of the storage containers.

4. The LNG storage container carrier according to claim 1, wherein the lower support includes a plurality of lower supports, the plurality of lower supports protruding vertically from bottom portions of the cargo holds, and reinforcement members each are disposed between two neighboring lower supports.

5. The LNG storage container carrier according to claim 1, further comprising a container loading table that is provided to carry container boxes together with the storage containers.

6. The LNG storage container carrier according to claim 1, wherein a thickness of the outer shell is greater than a thickness of the inner shell.

7. The LNG storage container carrier according to claim 1, wherein each of the storage containers further includes a support disposed between the inner shell and the outer shell, and wherein the support includes a first flange disposed on the outer surface of the inner shell, a plurality of members coupled between the first flange and a second flange, and a heat insulation member disposed between the second flange and an inner surface of the outer shell.

8. The LNG storage container carrier according to claim 7, wherein the plurality of members includes a first plurality of members and a second plurality of members, wherein the first plurality of members extends in a direction perpendicular to an outer surface of the first flange and an inner surface of the second flange, and wherein the second plurality of members has a truss structure.

9. The LNG storage container carrier according to claim 7, wherein the heat insulation layer includes perlite.

10. The LNG storage container carrier according to claim 1, wherein the connection passage includes a hole, a pipe, or both.

11. The LNG storage container carrier according to claim 1, wherein at least one of the first and second upper supports is coupled to a stanchion, a lashing bridge, or both.

12. A liquefied natural gas (LNG) storage container carrier comprising:

one or more cargo holds provided on a hull such that upper portions thereof are opened;

a plurality of first and second upper supports installed on the cargo holds in a width direction and a length direction to partition the upper portions of the cargo holds into a plurality of openings, wherein storage containers are vertically inserted into the openings such that upper portions of the storage containers over the openings are exposed to an external environment when the storage containers are carried using the LNG storage container carrier; and a lower support installed under the cargo holds and supporting bottoms of the storage containers inserted into the openings, wherein the LNG is an LNG that has been pressurized and liquefied at a pressure of 13 to 25 bar and a temperature of −120 to −95° C., wherein each of the storage containers includes an inner shell storing the LNG, an outer shell enclosing the inner shell, a heat insulation layer disposed between the inner shell and the outer shell, and a connection passage, between the inner shell and the heat insulation layer, providing a fluid path to make a pressure on an inside surface of the inner shell substantially equal to a pressure on an outside surface of the inner shell, and, wherein each of the storage containers further includes an external injection part coupled to an end part of the outer shell and having a first connecting part protruded from a bottom surface of the external injection part, and a second connecting part protruded from an end part of the inner shell, and wherein the first connecting part is slidably coupled to the second connecting part.

13. A liquefied natural gas (LNG) storage container carrier comprising:

one or more cargo holds provided in a hull;

a plurality of first upper supports disposed on the cargo holds and arranged in a first direction, each of the first upper supports extending in a second direction that crosses the first direction;

a plurality of second upper supports disposed on the cargo holds and arranged in the second direction, each of the second upper supports extending in the first direction, wherein the first and second upper supports intersect to provide a plurality of openings, wherein at least one of the first and second upper supports is coupled to a stanchion, a lashing bridge, or both;

a plurality of storage containers, wherein the plurality of storage containers are vertically inserted into the openings such that upper portions of the storage containers over the openings are exposed to an external environment when the storage containers are carried using the LNG storage container carrier; and a lower support installed under the cargo holds and supporting bottom surfaces of the storage containers inserted into the openings, wherein the LNG is an LNG that has been pressurized and liquefied at a pressure of 13 to 25 bar and a temperature of −120 to −95° C., wherein each of the storage containers includes an inner shell storing the LNG, an outer shell enclosing the inner shell, a heat insulation layer disposed between the inner shell and the outer shell, and a connection passage, between the inner shell and the heat insulation layer, providing a fluid path to make a pressure on an inside surface of the inner shell substantially equal to a pressure on an outside surface of the inner shell, and wherein each of the storage containers further includes an external injection part coupled to an end part of the outer shell, a connecting part coupled to the external injection part, and a buffer part coupled between the connecting part and an end part of the inner shell and having a tube-shaped structure.

14. A liquefied natural gas (LNG) storage container carrier comprising:

one or more cargo holds provided in a hull;

a plurality of first upper supports disposed on the cargo holds and arranged in a first direction, each of the first upper supports extending in a second direction that crosses the first direction;

a plurality of second upper supports disposed on the cargo holds and arranged in the second direction, each of the second upper supports extending in the first direction, wherein the first and second upper supports intersect to provide a plurality of openings, wherein at least one of the first and second upper supports is coupled to a stanchion, a lashing bridge, or both;

a plurality of storage containers, wherein the plurality of storage containers are vertically inserted into the openings such that upper portions of the storage containers over the openings are exposed to an external environment when the storage containers are carried using the LNG storage container carrier; and a lower support installed under the cargo holds and supporting bottom surfaces of the storage containers inserted into the openings, wherein the LNG is an LNG that has been pressurized and liquefied at a pressure of 13 to 25 bar and a temperature of −120 to −95° C., wherein each of the storage containers includes an inner shell storing the LNG, an outer shell enclosing the inner shell, a heat insulation layer disposed between the inner shell and the outer shell, and a connection passage, between the inner shell and the heat insulation layer, providing a fluid path to make a pressure on an inside surface of the inner shell substantially equal to a pressure on an outside surface of the inner shell, and wherein each of the storage containers further includes an external injection part coupled to an end part of the outer shell and having a first connecting part protruded from a bottom surface of the external injection part, and a second connecting part protruded from an end part of the inner shell, and wherein the first connecting part is slidably coupled to the second connecting part.

* * * * *